US011164527B2

(12) United States Patent
Hikichi

(10) Patent No.: US 11,164,527 B2
(45) Date of Patent: Nov. 2, 2021

(54) DEVICE AND METHOD FOR ADDRESSING UNINTENDED OFFSET VOLTAGE WHEN DRIVING DISPLAY PANEL

(71) Applicant: SYNAPTICS INCORPORATED, San Jose, CA (US)

(72) Inventor: Toshiyuki Hikichi, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/814,324

(22) Filed: Mar. 10, 2020

(65) Prior Publication Data

US 2021/0287607 A1 Sep. 16, 2021

(51) Int. Cl.
*G09G 3/36* (2006.01)
*G09G 3/3266* (2016.01)

(52) U.S. Cl.
CPC ... *G09G 3/3266* (2013.01); *G09G 2310/0291* (2013.01); *G09G 2320/02* (2013.01)

(58) Field of Classification Search
CPC ..... G09G 3/3266; G09G 2310/0291; G09G 2320/02
See application file for complete search history.

(56) References Cited

U.S. PATENT DOCUMENTS 8,723,851 B2 * 5/2014 Choe ..... G09G 3/3614 345/209
2003/0234757 A1 * 12/2003 Bu ..... G09G 3/3688 345/90
2009/0102777 A1 * 4/2009 Izumikawa ..... G09G 3/3614 345/96
2017/0287429 A1 * 10/2017 Kong ..... G09G 3/3607
2017/0358268 A1 * 12/2017 Nishio ..... G09G 3/3696
2019/0101755 A1 * 4/2019 Weng ..... G02B 27/017

* cited by examiner

*Primary Examiner* — Kwang-Su Yang
(74) *Attorney, Agent, or Firm* — Ferguson Braswell Fraser Kubasta PC

(57) ABSTRACT

A processing system comprises a plurality of output terminals connectable to data lines of a display panel and a plurality of output amplifiers configured to output a plurality of drive voltages, respectively. The drive voltages have the same polarity. The processing system further comprises first switch circuitry configured to connect a first output terminal of the plurality of output terminals to a selected one of the plurality of output amplifiers.

17 Claims, 25 Drawing Sheets

FIG. 5A

| VSync No. | Display Line No. | SW1 | SW2 | Output terminals 160 | | | | |
|---|---|---|---|---|---|---|---|---|
| | | | | 1 | 2 | 3 | 4 | ⋯ |
| #4n-3 | #1 | Straight | A | AMP #1 | AMP #2 | AMP #3 | AMP #4 | ⋯ |
| | #2 | Straight | B | AMP #1 | AMP #2 | AMP #3 | AMP #4 | ⋯ |
| | #3 | Cross | A | AMP #2 | AMP #1 | AMP #4 | AMP #3 | ⋯ |
| | #4 | Cross | B | AMP #2 | AMP #1 | AMP #4 | AMP #3 | ⋯ |
| | #5 | Straight | A | AMP #1 | AMP #2 | AMP #3 | AMP #4 | ⋯ |
| | #6 | Straight | B | AMP #1 | AMP #2 | AMP #3 | AMP #4 | ⋯ |
| | #7 | Cross | A | AMP #2 | AMP #1 | AMP #4 | AMP #3 | ⋯ |
| | #8 | Cross | B | AMP #2 | AMP #1 | AMP #4 | AMP #3 | ⋯ |
| | ⋮ | ⋮ | ⋮ | ⋮ | ⋮ | ⋮ | ⋮ | ⋱ |
| #4n-2 | #1 | Straight | B | AMP #1 | AMP #2 | AMP #3 | AMP #4 | ⋯ |
| | #2 | Straight | A | AMP #1 | AMP #2 | AMP #3 | AMP #4 | ⋯ |
| | #3 | Cross | B | AMP #2 | AMP #1 | AMP #4 | AMP #3 | ⋯ |
| | #4 | Cross | A | AMP #2 | AMP #1 | AMP #4 | AMP #3 | ⋯ |
| | #5 | Straight | B | AMP #1 | AMP #2 | AMP #3 | AMP #4 | ⋯ |
| | #6 | Straight | A | AMP #1 | AMP #2 | AMP #3 | AMP #4 | ⋯ |
| | #7 | Cross | B | AMP #2 | AMP #1 | AMP #4 | AMP #3 | ⋯ |
| | #8 | Cross | A | AMP #2 | AMP #1 | AMP #4 | AMP #3 | ⋯ |
| | ⋮ | ⋮ | ⋮ | ⋮ | ⋮ | ⋮ | ⋮ | ⋱ |

FIG. 5B

| VSync No. | Display Line No. | SW1 | SW2 | Output terminals 160 | | | | |
|---|---|---|---|---|---|---|---|---|
| | | | | 1 | 2 | 3 | 4 | ··· |
| #4n-1 | #1 | Cross | A | AMP #2 | AMP #1 | AMP #4 | AMP #3 | ··· |
| | #2 | Cross | B | AMP #2 | AMP #1 | AMP #4 | AMP #3 | ··· |
| | #3 | Straight | A | AMP #1 | AMP #2 | AMP #3 | AMP #4 | ··· |
| | #4 | Straight | B | AMP #1 | AMP #2 | AMP #3 | AMP #4 | ··· |
| | #5 | Cross | A | AMP #2 | AMP #1 | AMP #4 | AMP #3 | ··· |
| | #6 | Cross | B | AMP #2 | AMP #1 | AMP #4 | AMP #3 | ··· |
| | #7 | Straight | A | AMP #1 | AMP #2 | AMP #3 | AMP #4 | ··· |
| | #8 | Straight | B | AMP #1 | AMP #2 | AMP #3 | AMP #4 | ··· |
| | ⋮ | ⋮ | ⋮ | ⋮ | ⋮ | ⋮ | ⋮ | ⋱ |
| #4n | #1 | Cross | B | AMP #2 | AMP #1 | AMP #4 | AMP #3 | ··· |
| | #2 | Cross | A | AMP #2 | AMP #1 | AMP #4 | AMP #3 | ··· |
| | #3 | Straight | B | AMP #1 | AMP #2 | AMP #3 | AMP #4 | ··· |
| | #4 | Straight | A | AMP #1 | AMP #2 | AMP #3 | AMP #4 | ··· |
| | #5 | Cross | B | AMP #2 | AMP #1 | AMP #4 | AMP #3 | ··· |
| | #6 | Cross | A | AMP #2 | AMP #1 | AMP #4 | AMP #3 | ··· |
| | #7 | Straight | B | AMP #1 | AMP #2 | AMP #3 | AMP #4 | ··· |
| | #8 | Straight | A | AMP #1 | AMP #2 | AMP #3 | AMP #4 | ··· |
| | ⋮ | ⋮ | ⋮ | ⋮ | ⋮ | ⋮ | ⋮ | ⋱ |

FIG. 6

| VSync No. | Display Line No. | SW1 | SW2 | Output terminals 160 | | | | |
|---|---|---|---|---|---|---|---|---|
| | | | | 1 | 2 | 3 | 4 | ⋯ |
| #2n-1 | #1 | Straight | A | AMP #1 | AMP #2 | AMP #3 | AMP #4 | ⋯ |
| | #2 | Straight | B | AMP #1 | AMP #2 | AMP #3 | AMP #4 | ⋯ |
| | #3 | Cross | A | AMP #2 | AMP #1 | AMP #4 | AMP #3 | ⋯ |
| | #4 | Cross | B | AMP #2 | AMP #1 | AMP #4 | AMP #3 | ⋯ |
| | #5 | Straight | A | AMP #1 | AMP #2 | AMP #3 | AMP #4 | ⋯ |
| | #6 | Straight | B | AMP #1 | AMP #2 | AMP #3 | AMP #4 | ⋯ |
| | #7 | Cross | A | AMP #2 | AMP #1 | AMP #4 | AMP #3 | ⋯ |
| | #8 | Cross | B | AMP #2 | AMP #1 | AMP #4 | AMP #3 | ⋯ |
| | ⋮ | ⋮ | ⋮ | ⋮ | ⋮ | ⋮ | ⋮ | ⋱ |
| #2n | #1 | Straight | B | AMP #1 | AMP #2 | AMP #3 | AMP #4 | ⋯ |
| | #2 | Straight | A | AMP #1 | AMP #2 | AMP #3 | AMP #4 | ⋯ |
| | #3 | Cross | B | AMP #2 | AMP #1 | AMP #4 | AMP #3 | ⋯ |
| | #4 | Cross | A | AMP #2 | AMP #1 | AMP #4 | AMP #3 | ⋯ |
| | #5 | Straight | B | AMP #1 | AMP #2 | AMP #3 | AMP #4 | ⋯ |
| | #6 | Straight | A | AMP #1 | AMP #2 | AMP #3 | AMP #4 | ⋯ |
| | #7 | Cross | B | AMP #2 | AMP #1 | AMP #4 | AMP #3 | ⋯ |
| | #8 | Cross | A | AMP #2 | AMP #1 | AMP #4 | AMP #3 | ⋯ |
| | ⋮ | ⋮ | ⋮ | ⋮ | ⋮ | ⋮ | ⋮ | ⋱ |

FIG. 8A

| VSync No. | Display Line No. | SW1 | SW2 | Output terminals 160 | | | | |
|---|---|---|---|---|---|---|---|---|
| | | | | 1 | 2 | 3 | 4 | ... |
| #6n-5 | #1 | Straight | A | AMP #1 | AMP #2 | AMP #3 | AMP #4 | ... |
| | #2 | Straight | B | AMP #1 | AMP #2 | AMP #3 | AMP #4 | ... |
| | #3 | Cross1 | A | AMP #2 | AMP #1 | AMP #4 | AMP #3 | ... |
| | #4 | Cross1 | B | AMP #2 | AMP #1 | AMP #4 | AMP #3 | ... |
| | #5 | Cross2 | A | AMP #1 | AMP #3 | AMP #2 | AMP #5 | ... |
| | #6 | Cross2 | B | AMP #1 | AMP #3 | AMP #2 | AMP #5 | ... |
| | #7 | Straight | A | AMP #1 | AMP #2 | AMP #3 | AMP #4 | ... |
| | #8 | Straight | B | AMP #1 | AMP #2 | AMP #3 | AMP #4 | ... |
| | #9 | Cross1 | A | AMP #2 | AMP #1 | AMP #4 | AMP #3 | ... |
| | #10 | Cross1 | B | AMP #2 | AMP #1 | AMP #4 | AMP #3 | ... |
| | #11 | Cross2 | A | AMP #1 | AMP #3 | AMP #2 | AMP #5 | ... |
| | #12 | Cross2 | B | AMP #1 | AMP #3 | AMP #2 | AMP #5 | ... |
| | ⋮ | ⋮ | ⋮ | ⋮ | ⋮ | ⋮ | ⋮ | ⋱ |

FIG. 8B

| VSync No. | Display Line No. | SW1 | SW2 | Output terminals 160 | | | | |
|---|---|---|---|---|---|---|---|---|
| | | | | 1 | 2 | 3 | 4 | ... |
| #6n-4 | #1 | Straight | B | AMP #1 | AMP #2 | AMP #3 | AMP #4 | ... |
| | #2 | Straight | A | AMP #1 | AMP #2 | AMP #3 | AMP #4 | ... |
| | #3 | Cross1 | B | AMP #2 | AMP #1 | AMP #4 | AMP #3 | ... |
| | #4 | Cross1 | A | AMP #2 | AMP #1 | AMP #4 | AMP #3 | ... |
| | #5 | Cross2 | B | AMP #1 | AMP #3 | AMP #2 | AMP #5 | ... |
| | #6 | Cross2 | A | AMP #1 | AMP #3 | AMP #2 | AMP #5 | ... |
| | #7 | Straight | B | AMP #1 | AMP #2 | AMP #3 | AMP #4 | ... |
| | #8 | Straight | A | AMP #1 | AMP #2 | AMP #3 | AMP #4 | ... |
| | #9 | Cross1 | B | AMP #2 | AMP #1 | AMP #4 | AMP #3 | ... |
| | #10 | Cross1 | A | AMP #2 | AMP #1 | AMP #4 | AMP #3 | ... |
| | #11 | Cross2 | B | AMP #1 | AMP #3 | AMP #2 | AMP #5 | ... |
| | #12 | Cross2 | A | AMP #1 | AMP #3 | AMP #2 | AMP #5 | ... |
| | ⋮ | ⋮ | ⋮ | ⋮ | ⋮ | ⋮ | ⋮ | ⋱ |

FIG. 8C

| VSync No. | Display Line No. | SW1 | SW2 | Output terminals 160 | | | | |
|---|---|---|---|---|---|---|---|---|
| | | | | 1 | 2 | 3 | 4 | ... |
| #6n-3 | #1 | Cross1 | A | AMP #2 | AMP #1 | AMP #4 | AMP #3 | ... |
| | #2 | Cross1 | B | AMP #2 | AMP #1 | AMP #4 | AMP #3 | ... |
| | #3 | Cross2 | A | AMP #1 | AMP #3 | AMP #2 | AMP #5 | ... |
| | #4 | Cross2 | B | AMP #1 | AMP #3 | AMP #2 | AMP #5 | ... |
| | #5 | Straight | A | AMP #1 | AMP #2 | AMP #3 | AMP #4 | ... |
| | #6 | Straight | B | AMP #1 | AMP #2 | AMP #3 | AMP #4 | ... |
| | #7 | Cross1 | A | AMP #2 | AMP #1 | AMP #4 | AMP #3 | ... |
| | #8 | Cross1 | B | AMP #2 | AMP #1 | AMP #4 | AMP #3 | ... |
| | #9 | Cross2 | A | AMP #1 | AMP #3 | AMP #2 | AMP #5 | ... |
| | #10 | Cross2 | B | AMP #1 | AMP #3 | AMP #2 | AMP #5 | ... |
| | #11 | Straight | A | AMP #1 | AMP #2 | AMP #3 | AMP #4 | ... |
| | #12 | Straight | B | AMP #1 | AMP #2 | AMP #3 | AMP #4 | ... |
| | ⋮ | ⋮ | ⋮ | ⋮ | ⋮ | ⋮ | ⋮ | ⋱ |

FIG. 8D

| VSync No. | Display Line No. | SW1 | SW2 | Output terminals 160 | | | | |
|---|---|---|---|---|---|---|---|---|
| | | | | 1 | 2 | 3 | 4 | ... |
| #6n-2 | #1 | Cross1 | B | AMP #2 | AMP #1 | AMP #4 | AMP #3 | ... |
| | #2 | Cross1 | A | AMP #2 | AMP #1 | AMP #4 | AMP #3 | ... |
| | #3 | Cross2 | B | AMP #1 | AMP #3 | AMP #2 | AMP #5 | ... |
| | #4 | Cross2 | A | AMP #1 | AMP #3 | AMP #2 | AMP #5 | ... |
| | #5 | Straight | B | AMP #1 | AMP #2 | AMP #3 | AMP #4 | ... |
| | #6 | Straight | A | AMP #1 | AMP #2 | AMP #3 | AMP #4 | ... |
| | #7 | Cross1 | B | AMP #2 | AMP #1 | AMP #4 | AMP #3 | ... |
| | #8 | Cross1 | A | AMP #2 | AMP #1 | AMP #4 | AMP #3 | ... |
| | #9 | Cross2 | B | AMP #1 | AMP #3 | AMP #2 | AMP #5 | ... |
| | #10 | Cross2 | A | AMP #1 | AMP #3 | AMP #2 | AMP #5 | ... |
| | #11 | Straight | B | AMP #1 | AMP #2 | AMP #3 | AMP #4 | ... |
| | #12 | Straight | A | AMP #1 | AMP #2 | AMP #3 | AMP #4 | ... |
| | ⋮ | ⋮ | ⋮ | ⋮ | ⋮ | ⋮ | ⋮ | ⋱ |

FIG. 8E

| VSync No. | Display Line No. | SW1 | SW2 | Output terminals 160 | | | | |
|---|---|---|---|---|---|---|---|---|
| | | | | 1 | 2 | 3 | 4 | … |
| #6n-1 | #1 | Cross2 | A | AMP #1 | AMP #3 | AMP #2 | AMP #5 | … |
| | #2 | Cross2 | B | AMP #1 | AMP #3 | AMP #2 | AMP #5 | … |
| | #3 | Straight | A | AMP #1 | AMP #2 | AMP #3 | AMP #4 | … |
| | #4 | Straight | B | AMP #1 | AMP #2 | AMP #3 | AMP #4 | … |
| | #5 | Cross1 | A | AMP #2 | AMP #1 | AMP #4 | AMP #3 | … |
| | #6 | Cross1 | B | AMP #2 | AMP #1 | AMP #4 | AMP #3 | … |
| | #7 | Cross2 | A | AMP #1 | AMP #3 | AMP #2 | AMP #5 | … |
| | #8 | Cross2 | B | AMP #1 | AMP #3 | AMP #2 | AMP #5 | … |
| | #9 | Straight | A | AMP #1 | AMP #2 | AMP #3 | AMP #4 | … |
| | #10 | Straight | B | AMP #1 | AMP #2 | AMP #3 | AMP #4 | … |
| | #11 | Cross1 | A | AMP #2 | AMP #1 | AMP #4 | AMP #3 | … |
| | #12 | Cross1 | B | AMP #2 | AMP #1 | AMP #4 | AMP #3 | … |
| | ⋮ | ⋮ | ⋮ | ⋮ | ⋮ | ⋮ | ⋮ | ⋱ |

FIG. 8F

| VSync No. | Display Line No. | SW1 | SW2 | Output terminals 160 | | | | |
|---|---|---|---|---|---|---|---|---|
| | | | | 1 | 2 | 3 | 4 | ... |
| #6n | #1 | Cross2 | B | AMP #1 | AMP #3 | AMP #2 | AMP #5 | ... |
| | #2 | Cross2 | A | AMP #1 | AMP #3 | AMP #2 | AMP #5 | ... |
| | #3 | Straight | B | AMP #1 | AMP #2 | AMP #3 | AMP #4 | ... |
| | #4 | Straight | A | AMP #1 | AMP #2 | AMP #3 | AMP #4 | ... |
| | #5 | Cross1 | B | AMP #2 | AMP #1 | AMP #4 | AMP #3 | ... |
| | #6 | Cross1 | A | AMP #2 | AMP #1 | AMP #4 | AMP #3 | ... |
| | #7 | Cross2 | B | AMP #1 | AMP #3 | AMP #2 | AMP #5 | ... |
| | #8 | Cross2 | A | AMP #1 | AMP #3 | AMP #2 | AMP #5 | ... |
| | #9 | Straight | B | AMP #1 | AMP #2 | AMP #3 | AMP #4 | ... |
| | #10 | Straight | A | AMP #1 | AMP #2 | AMP #3 | AMP #4 | ... |
| | #11 | Cross1 | B | AMP #2 | AMP #1 | AMP #4 | AMP #3 | ... |
| | #12 | Cross1 | A | AMP #2 | AMP #1 | AMP #4 | AMP #3 | ... |
| | ⋮ | ⋮ | ⋮ | ⋮ | ⋮ | ⋮ | ⋮ | ⋱ |

FIG. 9A

| VSync No. | Display Line No. | SW1 | SW2 | Output terminals 160 | | | | |
|---|---|---|---|---|---|---|---|---|
| | | | | 1 | 2 | 3 | 4 | ... |
| #2n-1 | #1 | Straight | A | AMP #1 | AMP #2 | AMP #3 | AMP #4 | ... |
| | #2 | Straight | B | AMP #1 | AMP #2 | AMP #3 | AMP #4 | ... |
| | #3 | Cross1 | A | AMP #2 | AMP #1 | AMP #4 | AMP #3 | ... |
| | #4 | Cross1 | B | AMP #2 | AMP #1 | AMP #4 | AMP #3 | ... |
| | #5 | Cross2 | A | AMP #1 | AMP #3 | AMP #2 | AMP #5 | ... |
| | #6 | Cross2 | B | AMP #1 | AMP #3 | AMP #2 | AMP #5 | ... |
| | #7 | Straight | A | AMP #1 | AMP #2 | AMP #3 | AMP #4 | ... |
| | #8 | Straight | B | AMP #1 | AMP #2 | AMP #3 | AMP #4 | ... |
| | #9 | Cross1 | A | AMP #2 | AMP #1 | AMP #4 | AMP #3 | ... |
| | #10 | Cross1 | B | AMP #2 | AMP #1 | AMP #4 | AMP #3 | ... |
| | #11 | Cross2 | A | AMP #1 | AMP #3 | AMP #2 | AMP #5 | ... |
| | #12 | Cross2 | B | AMP #1 | AMP #3 | AMP #2 | AMP #5 | ... |
| | ⋮ | ⋮ | ⋮ | ⋮ | ⋮ | ⋮ | ⋮ | ⋱ |

FIG. 9B

| VSync No. | Display Line No. | SW1 | SW2 | Output terminals 160 | | | | |
|---|---|---|---|---|---|---|---|---|
| | | | | 1 | 2 | 3 | 4 | ··· |
| #2n | #1 | Straight | B | AMP #1 | AMP #2 | AMP #3 | AMP #4 | ··· |
| | #2 | Straight | A | AMP #1 | AMP #2 | AMP #3 | AMP #4 | ··· |
| | #3 | Cross1 | B | AMP #2 | AMP #1 | AMP #4 | AMP #3 | ··· |
| | #4 | Cross1 | A | AMP #2 | AMP #1 | AMP #4 | AMP #3 | ··· |
| | #5 | Cross2 | B | AMP #1 | AMP #3 | AMP #2 | AMP #5 | ··· |
| | #6 | Cross2 | A | AMP #1 | AMP #3 | AMP #2 | AMP #5 | ··· |
| | #7 | Straight | B | AMP #1 | AMP #2 | AMP #3 | AMP #4 | ··· |
| | #8 | Straight | A | AMP #1 | AMP #2 | AMP #3 | AMP #4 | ··· |
| | #9 | Cross1 | B | AMP #2 | AMP #1 | AMP #4 | AMP #3 | ··· |
| | #10 | Cross1 | A | AMP #2 | AMP #1 | AMP #4 | AMP #3 | ··· |
| | #11 | Cross2 | B | AMP #1 | AMP #3 | AMP #2 | AMP #5 | ··· |
| | #12 | Cross2 | A | AMP #1 | AMP #3 | AMP #2 | AMP #5 | ··· |
| | ⋮ | ⋮ | ⋮ | ⋮ | ⋮ | ⋮ | ⋮ | ⋱ |

FIG. 11A

| VSync No. | Display Line No. | SW1 | SW2 | Output terminals 160 | | | | |
|---|---|---|---|---|---|---|---|---|
| | | | | 1 | 2 | 3 | 4 | ... |
| #6n-5 | #1 | Straight | A | AMP #1 | AMP #2 | AMP #3 | AMP #4 | ... |
| | #2 | Straight | B | AMP #1 | AMP #2 | AMP #3 | AMP #4 | ... |
| | #3 | Cross1 | A | AMP #2 | AMP #1 | AMP #4 | AMP #3 | ... |
| | #4 | Cross1 | B | AMP #2 | AMP #1 | AMP #4 | AMP #3 | ... |
| | #5 | Cross2 | A | AMP #1 | AMP #3 | AMP #2 | AMP #4 | ... |
| | #6 | Cross2 | B | AMP #1 | AMP #3 | AMP #2 | AMP #4 | ... |
| | #7 | Straight | A | AMP #1 | AMP #2 | AMP #3 | AMP #4 | ... |
| | #8 | Straight | B | AMP #1 | AMP #2 | AMP #3 | AMP #4 | ... |
| | #9 | Cross1 | A | AMP #2 | AMP #1 | AMP #4 | AMP #3 | ... |
| | #10 | Cross1 | B | AMP #2 | AMP #1 | AMP #4 | AMP #3 | ... |
| | #11 | Cross2 | A | AMP #1 | AMP #3 | AMP #2 | AMP #4 | ... |
| | #12 | Cross2 | B | AMP #1 | AMP #3 | AMP #2 | AMP #4 | ... |
| | ⋮ | ⋮ | ⋮ | ⋮ | ⋮ | ⋮ | ⋮ | ⋱ |

FIG. 11B

| VSync No. | Display Line No. | SW1 | SW2 | Output terminals 160 | | | | |
|---|---|---|---|---|---|---|---|---|
| | | | | 1 | 2 | 3 | 4 | ... |
| #6n-4 | #1 | Straight | B | AMP #1 | AMP #2 | AMP #3 | AMP #4 | ... |
| | #2 | Straight | A | AMP #1 | AMP #2 | AMP #3 | AMP #4 | ... |
| | #3 | Cross1 | B | AMP #2 | AMP #1 | AMP #4 | AMP #3 | ... |
| | #4 | Cross1 | A | AMP #2 | AMP #1 | AMP #4 | AMP #3 | ... |
| | #5 | Cross2 | B | AMP #1 | AMP #3 | AMP #2 | AMP #4 | ... |
| | #6 | Cross2 | A | AMP #1 | AMP #3 | AMP #2 | AMP #4 | ... |
| | #7 | Straight | B | AMP #1 | AMP #2 | AMP #3 | AMP #4 | ... |
| | #8 | Straight | A | AMP #1 | AMP #2 | AMP #3 | AMP #4 | ... |
| | #9 | Cross1 | B | AMP #2 | AMP #1 | AMP #4 | AMP #3 | ... |
| | #10 | Cross1 | A | AMP #2 | AMP #1 | AMP #4 | AMP #3 | ... |
| | #11 | Cross2 | B | AMP #1 | AMP #3 | AMP #2 | AMP #4 | ... |
| | #12 | Cross2 | A | AMP #1 | AMP #3 | AMP #2 | AMP #4 | ... |
| | ⋮ | ⋮ | ⋮ | ⋮ | ⋮ | ⋮ | ⋮ | ⋱ |

FIG. 11C

| VSync No. | Display Line No. | SW1 | SW2 | Output terminals 160 | | | | |
|---|---|---|---|---|---|---|---|---|
| | | | | 1 | 2 | 3 | 4 | ... |
| #6n-3 | #1 | Cross1 | A | AMP #2 | AMP #1 | AMP #4 | AMP #3 | ... |
| | #2 | Cross1 | B | AMP #2 | AMP #1 | AMP #4 | AMP #3 | ... |
| | #3 | Cross2 | A | AMP #1 | AMP #3 | AMP #2 | AMP #4 | |
| | #4 | Cross2 | B | AMP #1 | AMP #3 | AMP #2 | AMP #4 | |
| | #5 | Straight | A | AMP #1 | AMP #2 | AMP #3 | AMP #4 | |
| | #6 | Straight | B | AMP #1 | AMP #2 | AMP #3 | AMP #4 | |
| | #7 | Cross1 | A | AMP #2 | AMP #1 | AMP #4 | AMP #3 | |
| | #8 | Cross1 | B | AMP #2 | AMP #1 | AMP #4 | AMP #3 | |
| | #9 | Cross2 | A | AMP #1 | AMP #3 | AMP #2 | AMP #4 | |
| | #10 | Cross2 | B | AMP #1 | AMP #3 | AMP #2 | AMP #4 | |
| | #11 | Straight | A | AMP #1 | AMP #2 | AMP #3 | AMP #4 | |
| | #12 | Straight | B | AMP #1 | AMP #2 | AMP #3 | AMP #4 | |
| | ⋮ | ⋮ | ⋮ | ⋮ | ⋮ | ⋮ | ⋮ | ⋱ |

FIG. 11D

| VSync No. | Display Line No. | SW1 | SW2 | Output terminals 160 | | | | |
|---|---|---|---|---|---|---|---|---|
| | | | | 1 | 2 | 3 | 4 | ... |
| #6n-2 | #1 | Cross1 | B | AMP #2 | AMP #1 | AMP #4 | AMP #3 | ... |
| | #2 | Cross1 | A | AMP #2 | AMP #1 | AMP #4 | AMP #3 | ... |
| | #3 | Cross2 | B | AMP #1 | AMP #3 | AMP #2 | AMP #4 | |
| | #4 | Cross2 | A | AMP #1 | AMP #3 | AMP #2 | AMP #4 | |
| | #5 | Straight | B | AMP #1 | AMP #2 | AMP #3 | AMP #4 | |
| | #6 | Straight | A | AMP #1 | AMP #2 | AMP #3 | AMP #4 | |
| | #7 | Cross1 | B | AMP #2 | AMP #1 | AMP #4 | AMP #3 | |
| | #8 | Cross1 | A | AMP #2 | AMP #1 | AMP #4 | AMP #3 | |
| | #9 | Cross2 | B | AMP #1 | AMP #3 | AMP #2 | AMP #4 | |
| | #10 | Cross2 | A | AMP #1 | AMP #3 | AMP #2 | AMP #4 | |
| | #11 | Straight | B | AMP #1 | AMP #2 | AMP #3 | AMP #4 | |
| | #12 | Straight | A | AMP #1 | AMP #2 | AMP #3 | AMP #4 | |
| | ⋮ | ⋮ | ⋮ | ⋮ | ⋮ | ⋮ | ⋮ | ⋱ |

FIG. 11E

| VSync No. | Display Line No. | SW1 | SW2 | Output terminals 160 | | | | |
|---|---|---|---|---|---|---|---|---|
| | | | | 1 | 2 | 3 | 4 | ... |
| #6n-1 | #1 | Cross2 | A | AMP #1 | AMP #3 | AMP #2 | AMP #4 | ... |
| | #2 | Cross2 | B | AMP #1 | AMP #3 | AMP #2 | AMP #4 | ... |
| | #3 | Straight | A | AMP #1 | AMP #2 | AMP #3 | AMP #4 | |
| | #4 | Straight | B | AMP #1 | AMP #2 | AMP #3 | AMP #4 | |
| | #5 | Cross1 | A | AMP #2 | AMP #1 | AMP #4 | AMP #3 | |
| | #6 | Cross1 | B | AMP #2 | AMP #1 | AMP #4 | AMP #3 | |
| | #7 | Cross2 | A | AMP #1 | AMP #3 | AMP #2 | AMP #4 | |
| | #8 | Cross2 | B | AMP #1 | AMP #3 | AMP #2 | AMP #4 | |
| | #9 | Straight | A | AMP #1 | AMP #2 | AMP #3 | AMP #4 | |
| | #10 | Straight | B | AMP #1 | AMP #2 | AMP #3 | AMP #4 | |
| | #11 | Cross1 | A | AMP #2 | AMP #1 | AMP #4 | AMP #3 | |
| | #12 | Cross1 | B | AMP #2 | AMP #1 | AMP #4 | AMP #3 | |
| | ⋮ | ⋮ | ⋮ | ⋮ | ⋮ | ⋮ | ⋮ | ⋱ |

FIG. 11F

| VSync No. | Display Line No. | SW1 | SW2 | Output terminals 160 | | | | |
|---|---|---|---|---|---|---|---|---|
| | | | | 1 | 2 | 3 | 4 | ... |
| #6n | #1 | Cross2 | B | AMP #1 | AMP #3 | AMP #2 | AMP #4 | ... |
| | #2 | Cross2 | A | AMP #1 | AMP #3 | AMP #2 | AMP #4 | ... |
| | #3 | Straight | B | AMP #1 | AMP #2 | AMP #3 | AMP #4 | |
| | #4 | Straight | A | AMP #1 | AMP #2 | AMP #3 | AMP #4 | |
| | #5 | Cross1 | B | AMP #2 | AMP #1 | AMP #4 | AMP #3 | |
| | #6 | Cross1 | A | AMP #2 | AMP #1 | AMP #4 | AMP #3 | |
| | #7 | Cross2 | B | AMP #1 | AMP #3 | AMP #2 | AMP #4 | |
| | #8 | Cross2 | A | AMP #1 | AMP #3 | AMP #2 | AMP #4 | |
| | #9 | Straight | B | AMP #1 | AMP #2 | AMP #3 | AMP #4 | |
| | #10 | Straight | A | AMP #1 | AMP #2 | AMP #3 | AMP #4 | |
| | #11 | Cross1 | B | AMP #2 | AMP #1 | AMP #4 | AMP #3 | |
| | #12 | Cross1 | A | AMP #2 | AMP #1 | AMP #4 | AMP #3 | |
| | ⋮ | ⋮ | ⋮ | ⋮ | ⋮ | ⋮ | ⋮ | ⋱ |

FIG. 12A

| VSync No. | Display Line No. | SW1 | SW2 | Output terminals 160 | | | | |
|---|---|---|---|---|---|---|---|---|
| | | | | 1 | 2 | 3 | 4 | ... |
| #2n-1 | #1 | Straight | A | AMP #1 | AMP #2 | AMP #3 | AMP #4 | ... |
| | #2 | Straight | B | AMP #1 | AMP #2 | AMP #3 | AMP #4 | ... |
| | #3 | Cross1 | A | AMP #2 | AMP #1 | AMP #4 | AMP #3 | |
| | #4 | Cross1 | B | AMP #2 | AMP #1 | AMP #4 | AMP #3 | |
| | #5 | Cross2 | A | AMP #1 | AMP #3 | AMP #2 | AMP #4 | |
| | #6 | Cross2 | B | AMP #1 | AMP #3 | AMP #2 | AMP #4 | |
| | #7 | Straight | A | AMP #1 | AMP #2 | AMP #3 | AMP #4 | |
| | #8 | Straight | B | AMP #1 | AMP #2 | AMP #3 | AMP #4 | |
| | #9 | Cross1 | A | AMP #2 | AMP #1 | AMP #4 | AMP #3 | |
| | #10 | Cross1 | B | AMP #2 | AMP #1 | AMP #4 | AMP #3 | |
| | #11 | Cross2 | A | AMP #1 | AMP #3 | AMP #2 | AMP #4 | |
| | #12 | Cross2 | B | AMP #1 | AMP #3 | AMP #2 | AMP #4 | |
| | ⋮ | ⋮ | ⋮ | ⋮ | ⋮ | ⋮ | ⋮ | ⋱ |

FIG. 12B

| VSync No. | Display Line No. | SW1 | SW2 | Output terminals 160 | | | | |
|---|---|---|---|---|---|---|---|---|
| | | | | 1 | 2 | 3 | 4 | ... |
| #2n | #1 | Straight | B | AMP #1 | AMP #2 | AMP #3 | AMP #4 | ... |
| | #2 | Straight | A | AMP #1 | AMP #2 | AMP #3 | AMP #4 | ... |
| | #3 | Cross1 | B | AMP #2 | AMP #1 | AMP #4 | AMP #3 | |
| | #4 | Cross1 | A | AMP #2 | AMP #1 | AMP #4 | AMP #3 | |
| | #5 | Cross2 | B | AMP #1 | AMP #3 | AMP #2 | AMP #4 | |
| | #6 | Cross2 | A | AMP #1 | AMP #3 | AMP #2 | AMP #4 | |
| | #7 | Straight | B | AMP #1 | AMP #2 | AMP #3 | AMP #4 | |
| | #8 | Straight | A | AMP #1 | AMP #2 | AMP #3 | AMP #4 | |
| | #9 | Cross1 | B | AMP #2 | AMP #1 | AMP #4 | AMP #3 | |
| | #10 | Cross1 | A | AMP #2 | AMP #1 | AMP #4 | AMP #3 | |
| | #11 | Cross2 | B | AMP #1 | AMP #3 | AMP #2 | AMP #4 | |
| | #12 | Cross2 | A | AMP #1 | AMP #3 | AMP #2 | AMP #4 | |
| | ⋮ | ⋮ | ⋮ | ⋮ | ⋮ | ⋮ | ⋮ | ⋱ |

DEVICE AND METHOD FOR ADDRESSING UNINTENDED OFFSET VOLTAGE WHEN DRIVING DISPLAY PANEL

BACKGROUND

Field

Embodiments disclosed herein generally relate to a device and method for driving a display panel.

Description of the Related Art

A display panel may comprise a plurality of data lines, which may be also referred to as source lines or signal lines. Drive voltages supplied to the data lines may be generated using a plurality of output amplifiers. In general, an output voltage of an output amplifier may include an unintended offset voltage specific to the output amplifier, which may be also referred to as output offset.

SUMMARY

This summary is provided to introduce in a simplified form a selection of concepts that are further described below in the Detailed Description. This summary is not intended to identify key features or essential features of the claimed subject matter, nor is it intended to limit the scope of the claimed subject matter.

In one or more embodiments, a processing system is provided. The processing system comprises a plurality of output terminals, a plurality of output amplifiers, and first switch circuitry. The output terminals are connectable to data lines of a display panel. The output amplifiers are configured to output a plurality of drive voltages, respectively, where the drive voltages have the same polarity. The first switch circuitry is configured to connect a first output terminal of the plurality of output terminals to a selected one of the plurality of output amplifiers.

In one or more embodiments, a display device is provided. The display device comprises a display panel and a processing system. The display panel comprises a plurality of data lines. The processing system comprises a plurality of output terminals, a plurality of output amplifiers, and first switch circuitry. The output terminals are connected to the data lines of the display panel. The output amplifiers are configured to output a plurality of drive voltages, respectively, where the drive voltages have the same polarity. The first switch circuitry is configured to connect a first output terminal of the plurality of output terminals to a selected one of the plurality of output amplifiers.

In one or more embodiments, a method for driving a display panel is provided. The method comprises outputting a first drive voltage from a first output amplifier to a first output terminal configured to be connected to a first data line of a display panel and outputting a second drive voltage having the same polarity as the first drive voltage from a second output amplifier to the first output terminal.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

FIGS. 5A and 5B illustrate example connection states of first switch circuitry and second switch circuitry, according to one or more embodiments.

FIG. 6 illustrates example connection states of first switch circuitry and second switch circuitry, according to one or more embodiments.

FIGS. 8A 8B, 8C, 8D, 8E, and 8F illustrate example operations of first switch circuitry and second switch circuitry, according to one or more embodiments.

FIGS. 9A and 9B illustrate example connection states of first switch circuitry and second switch circuitry, according to one or more embodiments.

FIGS. 11A, 11B, 11C, 11D, 11E, and 11F illustrate example connection states of first switch circuitry and second switch circuitry, according to one or more embodiments.

FIGS. 12A and 12B illustrate example connection states of first switch circuitry and second switch circuitry, according to one or more embodiments.

Figure 1:
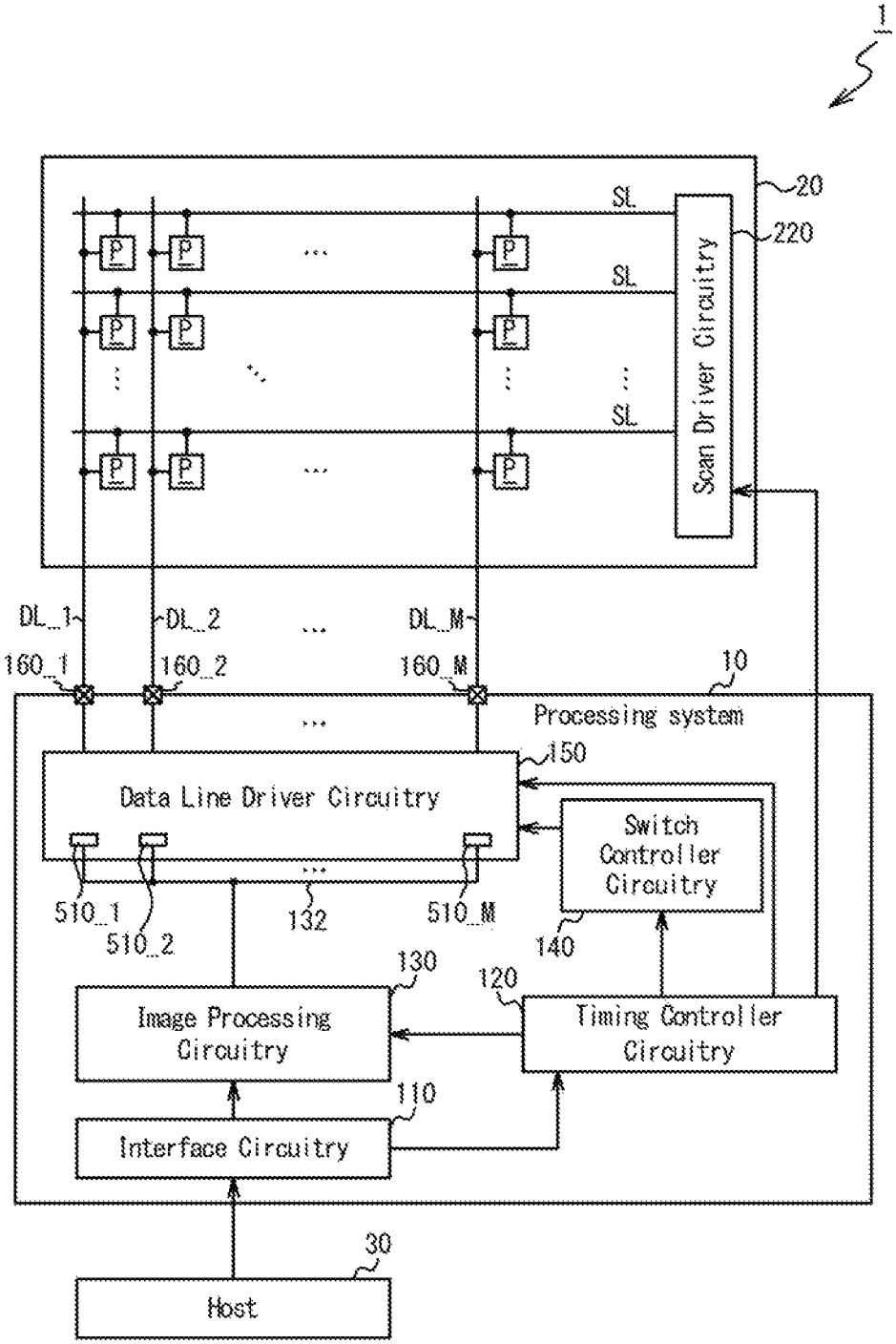
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Output amplifiers are often used to drive data lines of a display panel. An output voltage of an output amplifier may include an unintended offset voltage specific to the output amplifier, and variations in the offset voltage may deteriorate the image quality.

To address this drawback, in one or more embodiments, a processing system is configured to selectively connect an output terminal connected to a data line to a plurality of output amplifiers. This configuration enables offset voltage averaging in driving a display panel and thereby mitigates the image quality deterioration.

FIG. 1 illustrates an example configuration of a display device 1, according one or more embodiments. In the embodiment illustrated, the display device 1 comprises a processing system 10, a display panel 20 controlled by the processing system 10, and a host 30. The host 30 may be configured to supply image data corresponding to an image to be displayed on the display panel 20 and control commands that specify display timing and/or display settings to the processing system 10. The processing system 10 may be configured to supply, based on the image data and the control commands received from the host 30, drive voltages corresponding to the image data and timing signals to the display panel 20. Examples of the display panel 20 may include an organic light emitting diode (OLED) display panel and a micro LED display panel.

In one or more embodiments, the display panel 20 comprises a plurality of data lines DL, scan driver circuitry 220, a plurality of scan lines SL, and a plurality of pixel circuits P. The data lines DL may be connected to the processing system 10, and the scan lines SL may be connected to the scan driver circuitry 220. Each pixel circuit P is connected to a corresponding data line DL and scan line SL.

The scan driver circuitry 220 may be configured to sequentially drive the scan lines SL based on timing signals from the processing system 10 to select pixel circuits P to be programmed with drive voltages. Drive voltages from the data lines DL are applied to the selected pixel circuits P. In various embodiments, a row of pixel circuits P arrayed in parallel to a scan line SL are updated in one horizontal sync period. A plurality of pixel circuits P that are updated in one horizontal sync period may be hereinafter referred to as "display line."

In one or more embodiments, the processing system 10 comprises interface circuitry 110, timing controller circuitry 120, image processing circuitry 130, a data bus 132, switch controller circuitry 140, data line driver circuitry 150, and a plurality of output terminals 160. The plurality of output terminal 160 may comprise M output terminals 160_1 to 160_M.

The data line driver circuitry 150 may be connected to the data bus 132 via a plurality of input lines. In the embodiment illustrated in FIG. 1, the input lines are connected to a plurality of latch circuits 510 of the data line driver circuitry 150, respectively.

In one or more embodiments, the interface circuitry 110 is configured to exchange data and/or commands with an entity external to the processing system 10. The interface circuitry 110 may be configured to receive image data packets encapsulating image data, timing packets indicating the display timing, and control command packets used to update settings of the processing system 10 and the display panel 20 from the host 30. The interface circuitry 110 may be configured to transfer the received data and commands to desired circuits of the processing system 10 depending on the contents of the data and commands. For example, the interface circuitry 110 may be configured to transfer the image data to the image processing circuitry 130. In other embodiments, the interface circuitry 110 may be configured to process the image data and send the processed image data packet to the image processing circuitry 130.

The timing controller circuitry 120 is configured to control drive timing of display lines of the display panel 20. The timing controller circuitry 120 may be configured to generate timing signals, including a vertical sync signal and a horizontal sync signal. In one or more embodiments, the vertical sync signal defines vertical sync periods and the horizontal sync signal defines horizontal sync periods. The timing controller circuitry 120 may be configured to supply the generated timing signals to the image processing circuitry 130, the switch controller circuitry 140, the data line driver circuitry 150, and the scan driver circuitry 220. These circuitries may be configured to perform operations and processes in synchronization with the driving of the display lines based on the received timing signals.

The image processing circuitry 130 is configured to process image data received from the interface circuitry 110. The image processing circuitry 130 may be configured to generate processed image data by performing one or more processes selected from a plurality of image processes, which may include corrections of color and/or brightness, interpolation among pixels, and so forth. The image processing circuitry 130 may be configured to sequentially output the processed image data to the data bus 132.

The switch controller circuitry 140 is configured to control the data line driver circuitry 150 based on the vertical sync signal and/or the horizontal sync signal. The switch controller circuitry 140 may be configured to control switches disposed in the data line driver circuitry 150 depending on display lines selected to be driven and/or vertical sync periods.

The data line driver circuitry 150 is configured to output, from the output terminals 160, drive voltages to be supplied to the data lines DL based on the image data received from the data bus 132. In one or more embodiments, the output terminals 160_1 to 160_M are connected to the data lines DL_1 to DL_M, respectively. In other embodiments where the display panel 20 comprises multiplexers, each output terminal 160 may be connected to a plurality of data lines DL via a multiplexer.

The processing system 10 may be implemented, for example, as a single chip such as a display driver chip configured to drive the display panel 20. In other embodiments, the processing system 10 may be implemented across multiple chips. The multiple chips may be configured to drive different parts of the display panel 20.

Figure 2:
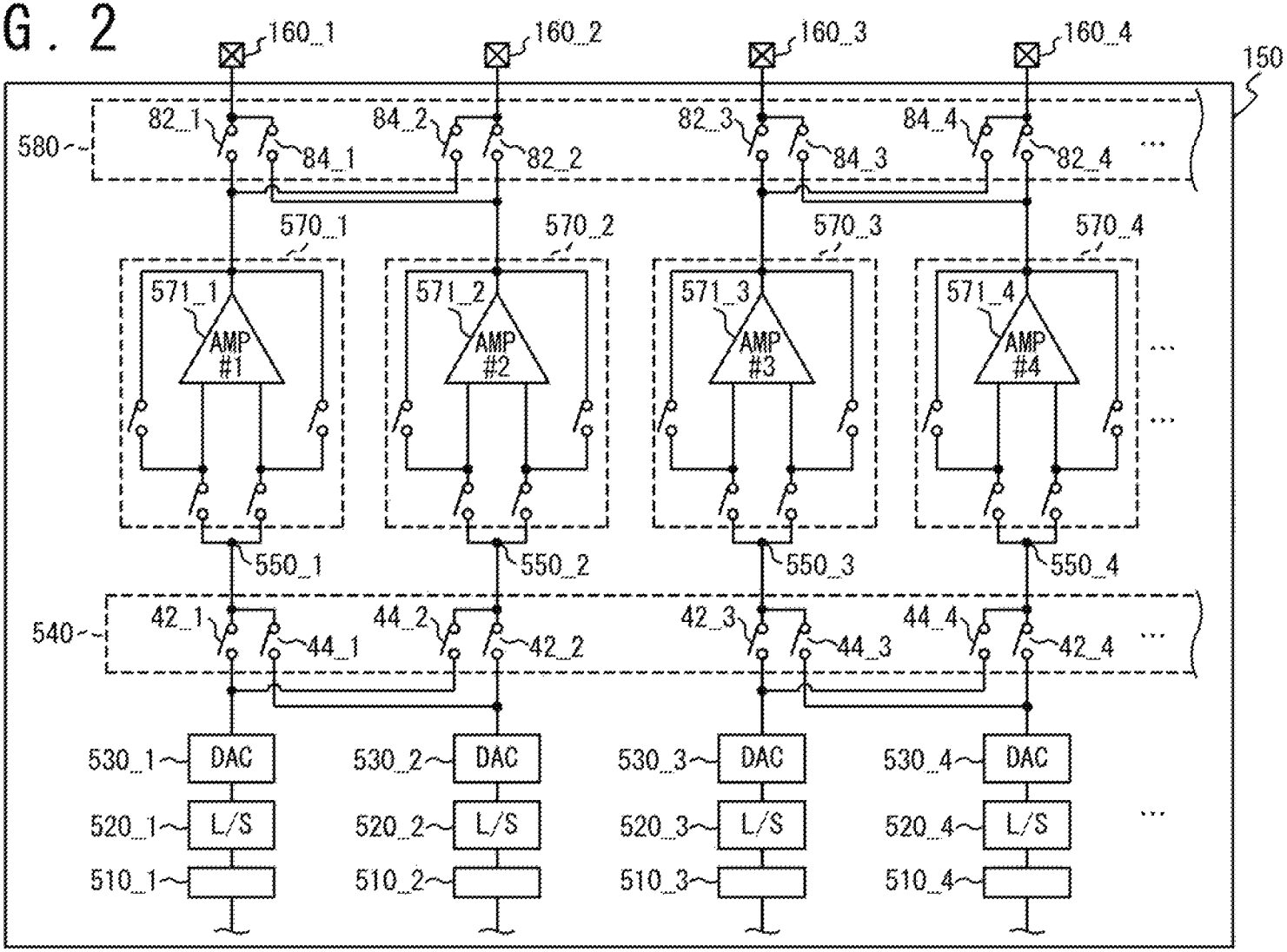
FIG. 2 illustrates an example configuration of data line driver circuitry according to one or more embodiments.

FIG. 2 illustrates an example configuration of the data line driver circuitry 150. In the embodiment illustrated, the data line driver circuitry 150 comprises a plurality of latch circuits 510, a plurality of level shifters (L/S) 520, a plurality of digital-analog converters (DACs) 530, third switch circuitry 540, a plurality of intermediate nodes 550, a plurality of output amplifiers 570, and first switch circuitry 580.

The latch circuits 510 are configured to latch associated image data transmitted over the data bus 132 and output the latched image data to the associated level shifters 520. In some embodiments, image data associated with the output terminals 160_1, 160_2, 160_3 . . . are sequentially supplied to the data bus 132 in this order, and accordingly the latch circuits 510_1, 510_2, 510_3 . . . are configured to latch the image data associated therewith in this order.

The level shifters 520 are configured to convert the signal levels of the image data received from the latch circuits 510 to match the input signal levels of the DACs 530. For example, the level shifter 520_*k* may be configured to receive image data associated with the output terminal 160_*k* from the latch circuit 510_*k* and perform level conversion of the received image data to output the level-converted image data to the DAC 530_*k*.

The DACs 530 are configured to generate grayscale voltages based on the image data received from the level shifters 520, respectively. For example, the DAC 530_*k* may be configured to receive the level-shifted image data associated with the output terminal 160_*k* from the level shifter 520_*k* and output a grayscale voltage acquired through digital-analog conversion of the level-shifted image data to the third switch circuitry 540.

The third switch circuitry 540 is configured to connect the output of each DAC 530 to one of the intermediate nodes 550. The intermediate nodes 550 may each receive a grayscale voltage generated by one of the DACs 530 selected by the third switch circuitry 540.

The output amplifiers 570_1-570_4 are described with reference to the example output amplifier 570_*k* of FIG. 3. For example, in the discussion related to the output amplifier 570_*k*, 570_*k* may refer to any one of the output amplifiers of 570_1-570_4 of FIG. 2, where "k" is 1, 2, 3, or 4. In the embodiment illustrated, the amplifier 570_*k* is configured to output a drive voltage corresponding to the grayscale voltage supplied to the associated intermediate node 550. The amplifier 570_*k* may comprise second switch circuitry 560_*k* and an amplifier circuit 571_*k*. The second switch circuitry 560_*k* may be configured to connect one of the input terminals 572_*k* and 574_*k* of the amplifier circuit 571_*k* to the output of the amplifier circuit 571_*k* and the other to the intermediate node 550_*k*. As discussed above, a drive voltage outputted from each amplifier circuit 571_*k* may include a specific output offset in addition to the voltage component corresponding to the grayscale voltage supplied to the amplifier circuit 571_*k*. The amplifier circuit 571_*k* may comprise an operational amplifier.

In one or more embodiments, the second switch circuitry 560_*k* comprises an A-type switch 62A_*k*, a B-type switch 62B_*k*, an A-type switch 64A_*k*, and a B-type switch 64B_*k*. The A-type switch 62A_*k* may be connected between the intermediate node 550_*k* and the input terminal 572_*k*, and the A-type switch 64A_*k* may be connected between the output of the amplifier circuit 571_*k* and the input terminal 574_*k*. The B-type switch 62B_*k* may be connected between the intermediate node 550_*k* and the input terminal 574_*k*, and the B-type switch 64B_*k* may be connected between the output of the amplifier circuit 571_*k* and the input terminal 572_*k*.

Referring back to FIG. 2, in one or more embodiments, the output amplifiers 570 are configured to output drive voltages of the same polarity to the output terminals 160. In various embodiments, the output amplifiers 570 are configured to operate on the same power source voltage and output the drive voltages so that the drive voltages are in the same voltage range. The maximum voltage levels of the drive voltages generated by the output amplifiers 570 may be equal to one another, and the minimum voltage levels of the drive voltages may be equal to one another. In some embodiments, the output amplifiers 570 have the same gain and/or the same circuit configuration.

The first switch circuitry 580 is configured to connect each of the output terminals 160 to a selected one of the output amplifiers 570. In various embodiments, the first switch circuitry 580 is configured to select the output amplifier 570 to be connected to one of the output terminals 160 from among the output amplifiers 570, depending on display lines selected to be driven.

The first switch circuitry 580 may comprise a plurality of straight switches 82 and a plurality of cross switches 84. Each output terminal 160 may be connected to one straight switch (e.g., a straight switch 82) and one or more cross switches (e.g., a cross switch 84).

In one or more embodiments, each of the straight switches 82 and the cross switches 84 is connected between one of the output terminals 160 and one of the outputs of the output amplifiers 570. In the embodiment illustrated in FIG. 2, the straight switch 82_*k* is connected between the output terminal 160_*k* and the output amplifier 570_*k* where k is a natural number (e.g., k=1, 2, 3 . . . ). The cross switch 84_*i* is connected between the output terminal 160_*i* and the output amplifier 570_(*i*+1) where i is an odd number (e.g., i=1, 3, 5 . . . ), and the cross switch 84_(*i*+1) is connected between the output terminal 160_(*i*+1) and the output amplifier 570_*i* where i+1 is an even number (e.g., i+1=2, 4, 6 . . . )

In one or more embodiments, the first switch circuitry 580 has a straight connection state and a cross connection state. In the straight connection state, the output terminal 160_*k* is connected to the output amplifier 570_*k*, where k is a natural number (e.g., k=1, 2, 3 . . . ); this also applies to the following discussion unless otherwise noted. For example, in the straight connection state, the straight switch 82_*k* may be turned on and other switches connected to the output terminal 160_*k* may be turned off. In the cross connection state, the output terminal 160_*k* is connected to a different output amplifier 570 other than the output amplifier 570_*k* (e.g., the output amplifier 570_(*k*+1) or 570_(*k*−1). For example, in the cross connection state, the cross switch 84_*k* may be turned on and other switches connected to the output terminal 160_*k* may be turned off. In various embodiments, during each connection state, one of the plurality of switches connected to each output terminal 160_*k* (e.g., the straight switch 82_*k* and the cross switch 84_*k*) is turned on and the other(s) is turned off. This allows the first switch circuitry 580 to connect the output terminal 160_*k* to a selected one of the output amplifiers 570.

In one or more embodiments, the first switch circuitry 580 is configured to select a connection state between the output terminal 160_*k* and its associated output amplifiers 570 from among a plurality of connection states including the straight connection state and the cross connection state. For example, the first switch circuitry 580 may be configured to switch the connection state between the output terminal 160_*k* and its associated output amplifiers 570 (e.g., the output amplifier 570_*k* and the output amplifier 570_(*k*+1)) between the straight connection state and the cross connection state, depending on display lines selected to be driven and/or vertical sync periods.

The data line driver circuitry 150 is configured to apply corresponding drive voltages to the output terminals 160, regardless of the connection state between the output terminals 160 and the output amplifiers 570 in the first switch circuitry 580. For example, the third switch circuitry 540 of the data line driver circuitry 150 may be configured to be adaptive to the connection state of the first switch circuitry 580 to apply the grayscale voltage generated based on the image data associated with the output terminal 160_*k* to the output amplifier 570 connected to the output terminal 160_*k* at that moment.

Referring to FIG. 2, the third switch circuitry 540 comprises a plurality of straight switches 42 and a plurality of cross switches 44 which are both connected between the DACs 530 and the intermediate nodes 550. For example, one intermediate node 550 may be connected to one straight switch (e.g., a straight switch 42) and one or more cross switches (e.g., a cross switch 44.) The number of cross switches connected to one intermediate node 550 may be equal to the number of cross switches connected to one output terminal 160. In various embodiments, the straight switches and cross switches connected to each intermediate node 550 are turned on one at a time.

The straight switch 42_*k* is connected between the intermediate node 550_*k* and the output of the DAC 530_*k*, where k is a natural number. The third switch circuitry 540 may be placed into the straight connection state in which the DAC 530_*k* is connected to the intermediate node 550_*k* by turning on each straight switch 42_*k*. In the straight connection state, the third switch circuitry 540 connects the output of the DAC 530_*k*, which generates the grayscale voltage associated with the output terminal 160_*k*, to the output amplifier 570_*k* via the intermediate node 550_*k*.

The cross switch 44_*i* of the third switch circuitry 540 is connected between the intermediate node 550_*i* and the output of the DAC 530_(*i*+1) where i is an odd number (that is, i=1, 3, 5 . . . ), and the cross switch 44_(*i*+1) is connected between the intermediate node 550_(*i*+1) and the output of the DAC 530_*i* where i+1 is an even number.

The third switch circuitry 540 may be placed in the cross connection state to connect the intermediate node 550_*k* to the DAC 530_(*k*+1) and/or connect the intermediate node 550_(*k*+1) to the DAC 530_*k* by turning on the cross switch 44_*k* and/or the cross switch 44_(*k*+1), where k is an odd number. When the third switch circuitry 540 is placed in the cross connection state, the output of the DAC 530_*k* that generates the grayscale voltage associated with the output terminal 160_*k* may be connected to the output amplifier 570_(*k*+1) via the intermediate node 550_(*k*+1), and the output of the DAC 530_(*k*+1) that generates the grayscale voltage associated with the output terminal 160_(*k*+1) is connected to the output amplifier 570_*k* via the intermediate node 550_*k*.

In one or more embodiments, when the first switch circuitry 580 is also placed in the straight connection state, the third switch circuitry 540 is also placed in the straight connection state. Correspondingly, when the first switch circuitry 580 is placed in the cross connection state, the third switch circuitry 540 is also placed in the cross connection state.

When the first switch circuitry 580 and the third switch circuitry 540 are both placed in the straight connection state, the output terminal 160_*k* is connected to the output of the output amplifier 570_*k* by the first switch circuitry 580, and the input of the output amplifier 570_*k* is connected to the DAC 530_*k* via the intermediate node 550_*k* by the third switch circuitry 540. Accordingly, in the straight connection state, the DAC 530_*k* receives image data associated with the output terminal 160_*k*, and the output amplifier 570_*k* generates and supplies a drive voltage to the output terminal 160_*k* based on a grayscale voltage received from the DAC 530_*k*.

When the first switch circuitry 580 and the third switch circuitry 540 are both placed in the cross connection state, the output terminal 160_*i* is connected to the output of the output amplifier 570_(*i*+1) and the input of the output amplifier 570_(*i*+1) is connected to the DAC 530_*i* via the intermediate node 550_(*i*+1) where i is an odd number, while the output terminal 160_(*i*+1) is connected to the output of the output amplifier 570_*i* and the input of the output amplifier 570_*i* is connected to the DAC 530_(*i*+1) via the intermediate node 550_(*i*+1), where i+1 is an even number. Accordingly, in the cross connection state, a grayscale voltage based on image data associated with the output terminal 160_*i* is supplied to the output amplifier 570_(*i*+1) and a drive voltage generated by the output amplifier 570_(*i*+1) is supplied to the output terminal 160_*i*, while a grayscale voltage based on image data associated with the output terminal 160_(*i*+1) is supplied to the output amplifier 570_*i* and a drive voltage generated by the output amplifier 570_*i* is supplied to the output terminal 160_(*i*+1).

In embodiments where the first switch circuitry 580 has a plurality of cross connection states, the third switch circuitry 540 may accordingly have a plurality of cross connection states. As thus described, the third switch circuitry 540 may be configured to supply a grayscale voltage generated based on image data associated with the output terminal 160_*k* to the output amplifier 570 connected to the output terminal 160_*k* adaptively to the plurality of connection states of the first switch circuitry 580.

In some embodiments, the data line driver circuitry 150 may be configured to switch the connection state of the third switch circuitry 540 in synchronization with the switching of the connection state of the first switch circuitry 580. In other embodiments, the switch controller circuitry 140 may be configured to switch the switch elements of the first switch circuitry 580 between the on-state and the off-state and switch the switch elements of the third switch circuitry 540 between the on-state and the off-state.

The above-described configuration of the first switch circuitry 580 may achieve time-averaging and/or spatial averaging of output offsets of the individual amplifier circuits 571. The drive voltages generated by the output amplifiers 570 may include offsets specific to the respective amplifier circuits 571. The offsets in the drive voltages supplied to the output terminals 160 may be different between the case where the first switch circuitry 580 is placed in the straight connection state and the case where the first switch circuitry 580 is placed in the cross connection state. The processing system 10 may be configured to achieve time-averaging and/or spatial averaging of the output offsets by switching the connection state of the first switch circuitry 580 between the straight connection state and the cross connection state at predetermined timing. For example, the processing system 10 may be configured to switch the connection state of the first switch circuitry 580 between the straight connection state and the cross connection state in units of a predetermined number of display lines and/or with a periodicity of a predetermined number of vertical sync periods.

Figure 3:
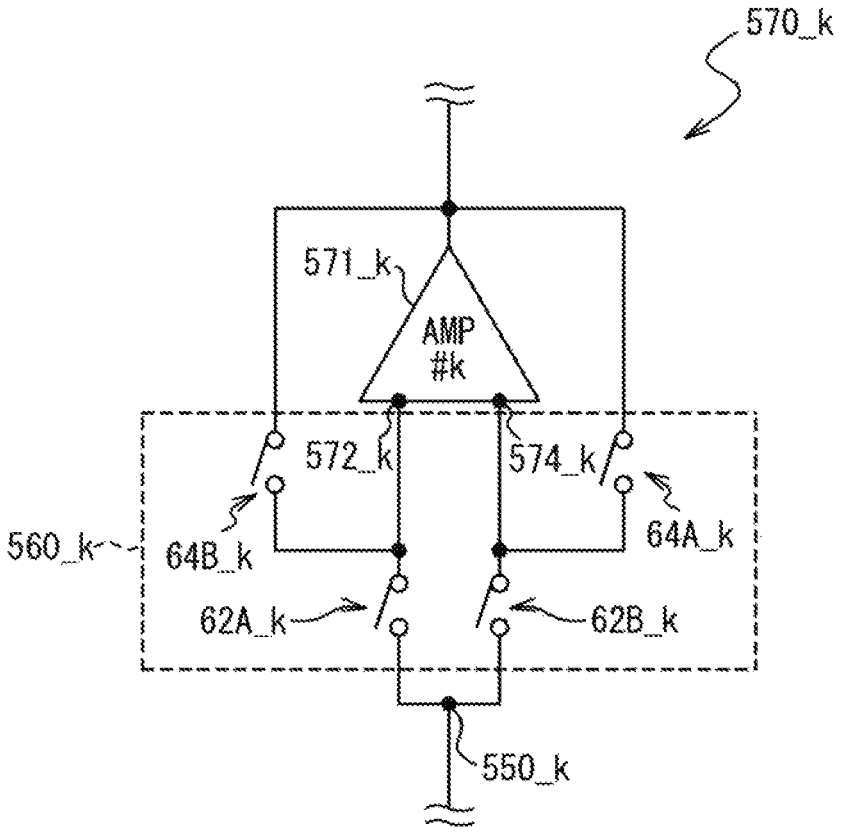
FIG. 3 illustrates an example configuration of an output amplifier, according to one or more embodiments.

Referring to FIG. 3, the second switch circuitry 560_*k* of the output amplifier 570_*k* may be configured to switch the connection state thereof between an A-type connection state and a B-type connection state. The second switch circuitry 560_*k* may be configured to, in the A-type connection state, connect the input terminal 572_*k* of the amplifier circuit 571_*k* to the intermediate node 550_*k* and the input terminal 574_*k* to the output of the amplifier circuit 571_*k*. For example, while in the A-type connection state, the A-type switches 62A_*k* and 64A_*k* may be turned on and the B-type switches 62B_*k* and 64B_*k* may be turned off. The second switch circuitry 560_*k* may be further configured to, in the B-type connection state, connect the input terminal 574_*k* of the amplifier circuit 571_*k* to the intermediate node 550_*k* and the input terminal 572_*k* to the output of the amplifier circuit 571_*k*. For example, while in the B-type connection state, the B-type switches 62B_*k* and 64B_*k* may be turned on and the A-type switches 62A_*k* and 64A_*k* may be turned off. The input terminal 572_*k* of the amplifier circuit 571_*k* may receive a grayscale voltage when the second switch circuitry 560_*k* is placed in the A-type connection state, and the input terminal 574_*k* may receive a grayscale voltage when the second switch circuitry 560_*k* is placed in the B-type connection state.

The above-described configuration of the second switch circuitry 560_*k* may achieve time-averaging and/or spatial averaging of output offsets of the individual amplifier circuits 571. As described above, the drive voltages generated by the output amplifiers 570 may include offsets specific to the respective amplifier circuits 571. The amplitudes and/or polarities of the output offsets may vary between the case where grayscale voltages are supplied to the input terminals 572 and the case where grayscale voltages are supplied to the input terminals 574. Accordingly, the output offsets of the output amplifiers 570 may vary between the A-type connection state and the B-type connection state. The processing system 10 may be configured to achieve time-averaging and/or spatial averaging of the output offsets by switching the connection state of the second switch circuitry 560 between the A-type connection state and the B-type connection state at predetermined timing. The processing system 10 may be configured to switch the connection state of the second switch circuitry 560 between the A-type connection state and the B-type connection state in units of a predetermined number of display lines and/or with a periodicity of a predetermined number of vertical sync periods.

Figure 4:
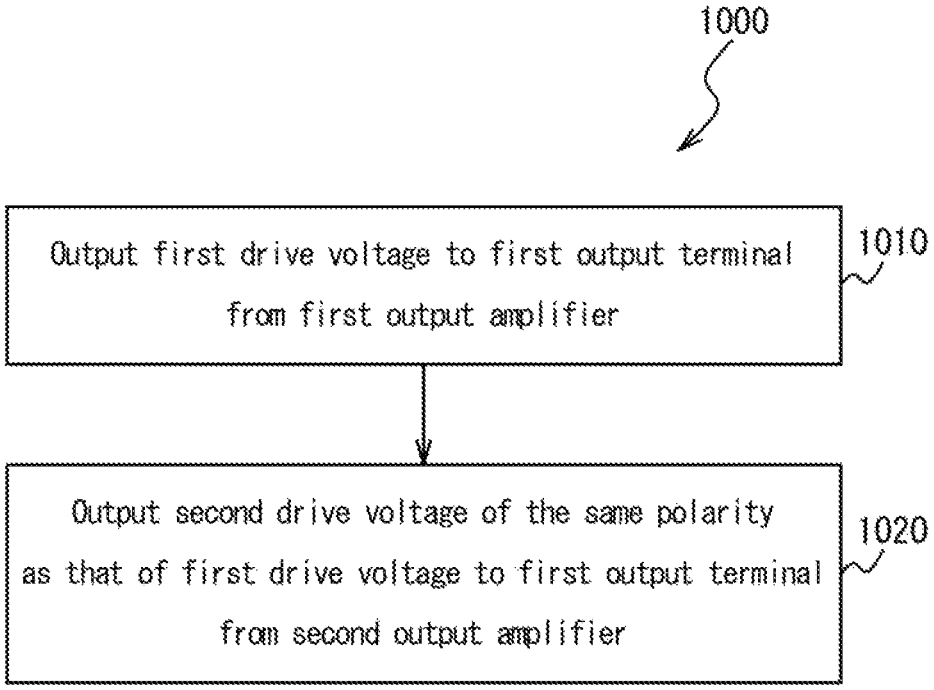
FIG. 4 illustrates an example method for outputting drive voltages to output terminals, according to one or more embodiments.

Method 1000 of FIG. 4 illustrates steps for operating the processing system 10, according to one or more embodiments. In the embodiment illustrated, in step 1010, the processing system 10 outputs a first drive voltage to a first output terminal (e.g., the output terminal 160_*k*) from a first amplifier (e.g., the output amplifier 570_*k*). The processing system 10 may place the first switch circuitry 580 of the data line driver circuitry 150 in the straight connection state in step 1010. For the embodiment illustrated in FIG. 2, this allows the output amplifier 570_*k* to output a drive voltage to the output terminal 160_*k*. For example, the output amplifier 570_1 outputs a drive voltage to the output terminal 160_1, and the output amplifier 570_2 outputs a drive voltage to the output terminal 160_2.

In step 1020, the processing system 10 outputs a second drive voltage to the first output terminal (e.g., the output terminal 160_*k*) from a second amplifier (e.g., the output amplifier 570_(*k*+1) or the output amplifier 570_(*k*−1)), where the second drive voltage has the same polarity of the first drive voltage outputted in step 1010. The processing system 10 may place the first switch circuitry 580 in the cross connection state in step 1020. For the embodiment illustrated in FIG. 2, this allows the output amplifier 570_*i*+1 to output a drive voltage to the output terminal 160_*i*, and the output amplifier 570_*i* to output a drive voltage to the output terminal 160_(*i*+1), where i is an odd number. For example, the output amplifier 570_1 outputs a drive voltage to the output terminal 160_2, and the output amplifier 570_2 outputs a drive voltage to the output terminal 160_1.

FIGS. 5A and 5B illustrates example switching of the connection state of the first switching circuitry 580, according to one or more embodiments. In the embodiment illustrated, the connection state of the first switch circuitry 580 is periodically switched depending on display lines selected to be driven. The connection state of the first switch circuitry 580 may be periodically switched between the straight connection state and the cross connection state in synchronization with the sequential driving of the display lines. For example, the first switch circuitry 580 may be switched between the straight connection state and the cross connection state with a periodicity of time during which four display lines are driven (or with a periodicity of four horizontal sync periods). The first switch circuitry 580 may be placed in the straight connection state when display lines #4m−3 and #4m−2 (e.g., display lines #1 and #2) are driven in vertical sync period #4n−3, where m is a natural number. In this connection state, the amplifier circuit 571_*k* (denoted as "AMP #k" in FIGS. 5A and 5B, where "k" is 1, 2, 3, or 4) of the output amplifier 570_*k* may output a drive voltage to the output terminal 160_*k*. For example, referring to FIG. 2, the amplifier circuit 571_1 (denoted as "AMP #1") of the output amplifier 570_1 may output a drive voltage to the output terminal 160_1. The first switch circuitry 580 may be placed in the cross connection state when display lines #4m−1 and #4m (e.g., display lines #3 and #4) are driven in vertical sync period #4n−3. In this connection state, the amplifier circuit 571_(*i*+1) (denoted as "AMP #i+1") of the output amplifier 570_(*i*+1) may output a drive voltage to the output terminal 160_*i*, where i is an odd number, and the amplifier circuit 571_*i* (denoted as "AMP #i") of the output amplifier 570_*i* may output a drive voltage to the output terminal 160_(*i*+1). For example, the amplifier circuit 571_2 (denoted as "AMP #2") of the output amplifier 570_2 outputs a drive voltage to the output terminal 160_1, and the amplifier circuit 571_1 (denoted as "AMP #1") of the output amplifier 570_1 outputs a drive voltage to the output terminal 160_2. Such operation, which switches output amplifiers 570 that output drive voltages to the respective output terminals 160 depending on display lines selected to be driven, enables spatially averaging the output offsets of the output amplifiers 570.

In one or more embodiments, the connection state of the second switch circuitry 560 in each output amplifier 570 is periodically switched depending on display lines selected to be driven. The connection state of the second switch circuitry 560 may be periodically switched between the A-type connection state and the B-type connection state in synchronization with the sequential driving of the display lines. For example, as illustrated in FIGS. 5A and 5B, the second switch circuitry 560 may be switched between the A-type connection state and the B-type connection state with a periodicity of time during which two display lines are driven (or with a periodicity of two horizontal sync periods). In vertical sync period #4n−3, the second switch circuitry 560 may be placed in the A-type connection state when the odd-numbered display lines #1, #3, #5 . . . are driven and placed in the B-type connection state when the even-numbered display lines #2, #4, #6 . . . are driven. In such embodiments, drive voltages including different output offsets associated with the input terminals 572 and 574 may be applied to each output terminal 160 depending on the display lines selected to be driven. The switching of the connection state of the second switch circuitry 560 may achieve spatial averaging of the output offsets of the output amplifiers 570.

In one or more embodiments, the connection states of the first switch circuitry 580 and the second switch circuitry 560 of each output amplifier 570 are switched with a periodicity determined based on the number of the connection states of the first switch circuitry 580 and the number of the connection states of the second switch circuitry 560. The connection states of the first switch circuitry 580 and the second switch circuitry 560 may be switched with a periodicity of time during which a number of display lines are driven, the number being the product of the number of the connection states of the first switch circuitry 580 and the number of the connection states of the second switch circuitry 560. For example, as illustrated in FIGS. 5A and 5B, the connection states of the first switch circuitry 580 and the second switch circuitry 560 may be switched with a periodicity of time during which four display lines are driven.

In one or more embodiments, the second switch circuitry 560 may be switched between the A-type connection state and the B-type connection state depending on display lines selected to be driven while the connection state of the first switch circuitry 580 is fixed to the straight connection state or the cross connection state. In vertical sync period #4n−3, for example, the second switch circuitry 560 may be switched from the A-type connection state to the B-type connection state while the first switch circuitry 580 is maintained in the straight connection state in the period during which the display lines #1 and #2 are driven. The second switch circuitry 560 may be switched from the A-type connection state to the B-type connection state while the first switch circuitry 580 is maintained in the cross connection state in the period during which the display lines #3 and #4 are driven.

In one or more embodiments, the connection state of the first switch circuitry 580 is periodically switched depending on vertical sync periods. The connection state of the first switch circuitry 580 used to drive each display line may be periodically switched based on elapses of vertical sync periods. As illustrated in FIGS. 5A and 5B, the connection state of the first switch circuitry 580 used to drive each display line may be switched between the straight connection state and the cross connection state at a periodicity of four vertical sync periods. For example, the first switch circuitry 580 may be placed in the straight connection state in driving display line #1 in vertical sync periods #4n−3 and #4n−2 and placed in the cross connection state in driving display line #1 in vertical sync periods #4n−1 and #4n. This operation, in which output amplifiers 570 used to output drive voltages to the respective output terminals 160 are switched based on vertical sync periods, enables time-averaging the output offsets of the output amplifiers 570.

In one or more embodiments, the connection state of the second switch circuitry 560 of each output amplifier 570 is periodically switched depending on vertical sync periods. The connection state of the second switching circuitry 560 used to drive the respective display lines may be periodically switched based on elapses of vertical sync periods. For example, as illustrated in FIGS. 5A and 5B, the connection state of the second switch circuitry 560 used to drive the respective display lines may be switched between the A-type connection state and the B-type connection state at a periodicity of two vertical sync periods. For example, the second switch circuitry 560 may be placed in the A-type connection state in driving display line #1 in vertical sync periods #4n−3, and placed in the B-type connection state in driving display line #1 in vertical sync periods #4n−2. This operation, in which the connection state of the second switch circuitry 560 used to drive the respective display lines are switched depending on vertical sync periods, enables time-averaging the output offsets of the output amplifiers 570.

In one or more embodiments, the connection states of the first switch circuitry 580 and the second switch circuitry 560 of each output amplifier 570 are switched in response to elapses of vertical sync periods with a periodicity determined based on the number of the connection states of the first switch circuitry 580 and the number of the connection states of the second switch circuitry 560. The connection states of the first switch circuitry 580 and the second switch circuitry 560 may be switched with a periodicity of a number of vertical sync periods, the number being the product of the number of the connection states of the first switch circuitry 580 and the number of the connection states of the second switch circuitry 560. For example, as illustrated in FIGS. 5A and 5B, the connection states of the first switch circuitry 580 and the second switch circuitry 560 may be switched with a periodicity of four vertical sync periods.

In one or more embodiments, the connection state of the second switch circuitry 560 used to drive the respective display lines may be switched between the A-type connection state and the B-type connection state depending on vertical sync periods, while the connection state of the first switch circuitry 580 is maintained in the straight connection state or the cross connection state. For example, as illustrated in FIGS. 5A and 5B, the connection state of the second switch circuitry 560 used to drive display line #1 may be switched from the A-type connection state to the B-type connection state between vertical sync periods #4n−3 and #4n−2 in which the connection state of the first switch circuitry 580 used to drive display line #1 is the straight connection state. The connection state of the second switch circuitry 560 used to drive display line #1 may be switched from the A-type connection state to the B-type connection state between vertical sync periods #4n−1 and #4n in which the connection state of the first switch circuitry 580 used to drive display line #1 is the cross connection state.

FIG. 6 illustrates an example operation of the first switch circuitry 580 in other embodiments. In the embodiment illustrated, the connection state of the first switch circuitry 580 used to drive the respective display lines is independent of vertical sync periods. For example, the connection state of the first switch circuitry 580 used to drive display line #1 may be fixed to the straight connection state in vertical sync periods #2n−1 and #2n. In other embodiments, the connection state of the first switch circuitry 580 used to drive display line #1 may be fixed to the cross connection state in vertical sync periods #2n−1 and #2n. Also, in such embodiments, the output offsets of the output amplifiers 570 may be time-averaged by switching the connection state of the second switch circuitry 560 depending on vertical sync periods.

The processing system 10 may be configured to switch the connection states of the first switch circuitry 580 and the second switch circuitry 560 depending on display lines selected to be driven and/or vertical sync periods in a different way, not limited to the embodiments illustrated in FIGS. 5A, 5B, and 6. In various embodiments, the number of display lines selected to be driven and/or the number of vertical sync periods that fall in one cycle of periodicity may be arbitrarily selected.

For example, the connection state of the first switch circuitry 580 may be switched with a periodicity of time during which two display lines are driven, and the connection state of the second switch circuitry 560 may be switched at a periodicity of time during which four display lines are driven. For example, in driving display line #1 in vertical sync period #4n−3, the first switch circuitry 580 may be set to the straight connection state and the second switch circuitry 560 may be set to the A-type connection state. In driving display line #2 in vertical sync period #4n−3, the first switch circuitry 580 may be set to the cross connection state and the second switch circuitry 560 may be set to the A-type connection state. In driving display line #3 in vertical sync period #4n−3, the first switch circuitry 580 may be set to the straight connection state and the second switch circuitry 560 may be set to the B-type connection state. In driving display line #4 in vertical sync period #4n−3, the first switch circuitry 580 may be set to the cross connection state and the second switch circuitry 560 may be set to the B-type connection state.

Figure 7:
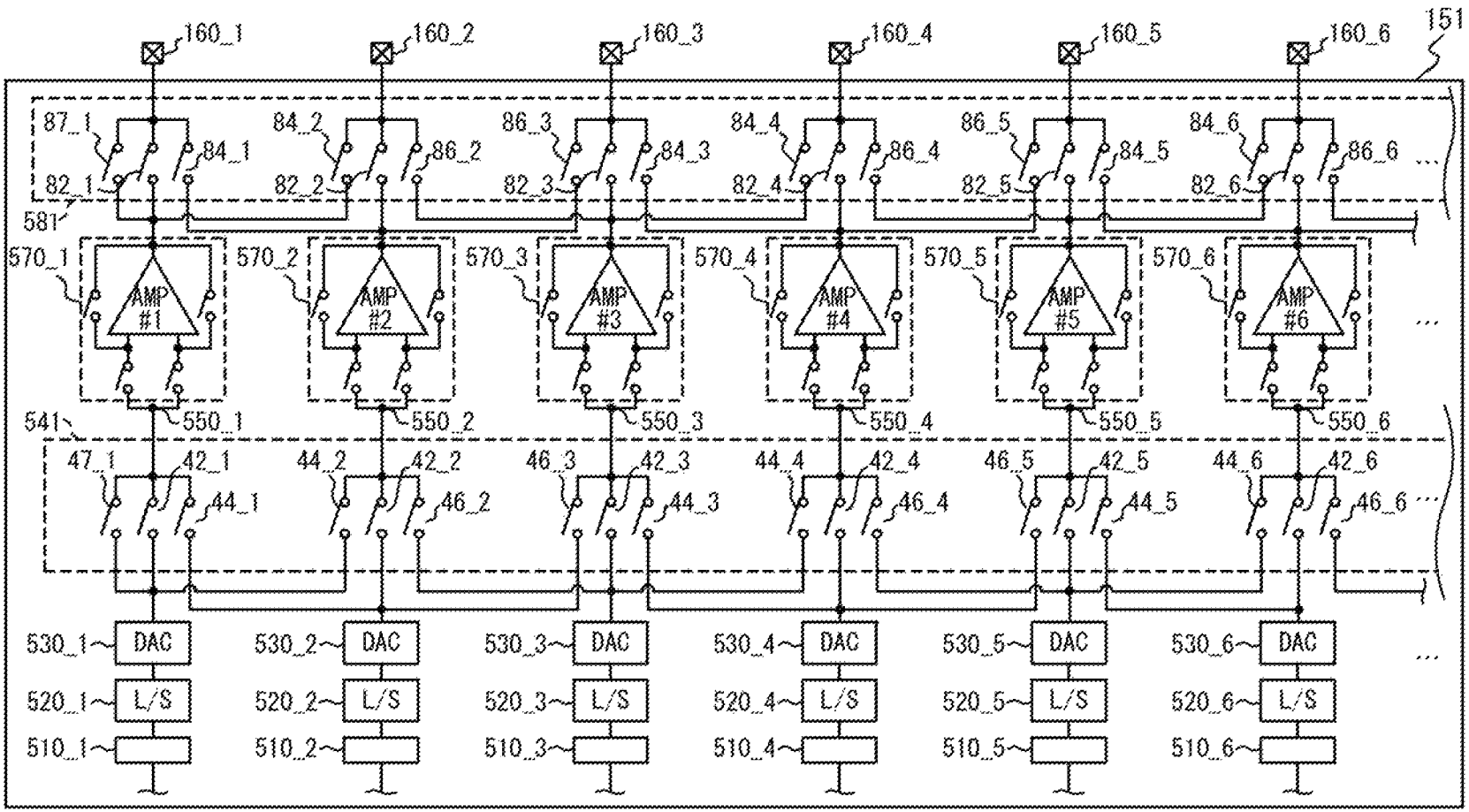
FIG. 7 illustrates an example configuration of data line driver circuitry, according to one or more embodiments.

FIG. 7 illustrates an example configuration of the processing system 10, according to other embodiments. In the embodiment illustrated, the processing system 10 comprises data line driver circuitry 151 in place of the data line driver circuitry 150 described in relation to FIG. 2. The data line driver circuitry 151 may comprise first switch circuitry 581 and third switch circuitry 541. The data line driver circuitry 151 may further comprise a plurality of latch circuits 510, a plurality of level shifters 520, a plurality of DACs 530, and a plurality of output amplifiers 570, similarly to the embodiment illustrated in FIG. 2.

In one or more embodiments, the data line driver circuitry 151 is configured to output a drive voltage to each of the plurality of output terminals 160 from a selected one of two or three output amplifiers 570. In embodiments where the processing system 10 comprises M output terminals 160_1 to 160_M, the data line driver circuitry 151 may be configured to connect each of the output terminals 160_1 and 160_M located at both ends to a selected one of two corresponding output amplifiers 570. The data line driver circuitry 151 may be further configured to connect each of other output terminals 160_2 and 160_(M−1) to a selected one of three corresponding output amplifiers 570.

The first switch circuitry 581 of the data line driver circuitry 151 may comprise a plurality of straight switches 82, a plurality of first cross switches 84, and a plurality of second cross switches 86. The straight switch 82_*k* may be connected between the output terminal 160_*k* and the output amplifier 570_*k*, where k is a natural number (e.g., k=1, 2, 3 . . . ). The first cross switch 84_*i* may be connected between the output terminal 160_*k* and the output amplifier 570_(*i*+1) for i being an odd number and connected between the output terminal 160_*i* and the output amplifier 570_(*i*−1) for i being an even number. The second cross switch 86_*i* may be connected between the output terminal 160_*i* and the output amplifier 570_(*i*+1) for i being an even number and connected between the output terminal 160_*i* and the output amplifier 570_(*i*−1) for i being an odd number.

The first switch circuitry 581 may comprise one or more dummy cross switches 87. For example, the one or more dummy cross switches 87 may include dummy cross switches 87_1 and 87_M. In the embodiment illustrated, there is not an output amplifier 570_0 and the output terminal 160_1 is not connected to a second cross switch 86_1. In relation to this, the dummy cross switch 87_1 may be connected between the output terminal 160_1 and the output amplifier 570_1 in place of providing the second cross switch 86_1. Further, there is not an output amplifier 570_(M+1) and the output terminal 160_M is not connected to a first cross switch 84_M or a second cross switch 86_M. In relation to this, the dummy cross switch 87_M may be connected between the output terminal 160_M and the output amplifier 570_M.

In one or more embodiments, the first switch circuitry 581 has a straight connection state, a first cross connection state, and a second cross connection state. In the straight connection state, the output terminal 160_*j* is connected to the output amplifier 570_*j* by the straight switch 82_*j*, where j=2 to M−1. In the first cross connection state, the output terminal 160_*j* is connected to the output amplifier 570_(*j*+1) or 570_(*j*−1) by the first cross switch 84_*j*. In the second cross connection state, the output terminal 160_*j* is connected to the output amplifier 570_(*j*−1) or 570_(*j*+1) by the second cross switch 86_*j*. The first switch circuitry 581 may be configured to switch the connection state thereof among the straight connection state, the first cross connection state, and the second cross connection state.

In the straight connection state, the straight switch 82_*j*, which is one of the switches connected to the output terminal 160_*j*, is turned on in the straight connection state while the other switches are turned off. The first cross switch 84_*j*, which is another of the switches connected to the output terminal 160_*j*, is turned on in the first cross connection state while the other switches are turned off. The second cross switch 86_*j*, which is the other of the switches connected to the output terminal 160_*j*, is turned on in the second cross connection state while the other switches are turned off. It should be noted that, for the output terminals 160_1 and 160_M, the dummy cross switches 87_1 and 87_M may be turned on in the second cross connection state (or in the first cross connection state). This configuration allows the processing system 10 to appropriately switch the connections between the output terminals 160 and the output amplifiers 570 with the control to switch the three connection states for the configuration in which the numbers of the output amplifiers 570 to be connected to each output terminal 160 vary between two and three.

In one or more embodiments, the third switch circuitry 541 comprises a plurality of straight switches 42, a plurality of first cross switches 44, a plurality of second cross switches 46 and one or more dummy cross switches 47. The straight switch 42_*k* may be connected between the intermediate node 550_*k* and the DAC 530_*k*, where k is a natural number (e.g., k=1, 2, 3 . . . ). The first cross switch 44_*k* may be connected between the intermediate node 550_*k* and the DAC 530_(*k*+1) for k being an odd number and connected between the intermediate node 550_*k* and the DAC 530_(*k*−1) for k being an even number. The second cross switch 46_*k* may be connected between the intermediate node 550_*k* and the DAC 530_(*k*−1) for k being an odd number and connected between the intermediate node 550_*k* and the DAC 530_(*k*+1) for k being an even number.

In one or more embodiments, when the first switch circuitry 581 is placed in the straight connection state, the third switch circuitry 541 may be also placed in the straight connection state in which the straight switches 42 are turned on and the other switches are turned off. Further, when the first switch circuitry 581 is placed in the first cross connection state, the third switch circuitry 541 may be also placed in the first cross connection state in which the first cross switches 44 are turned on and the other switches are turned off. Further, when the first switch circuitry 581 is placed in the second cross connection state, the third switch circuitry 541 may be also placed in the second cross connection state in which the second cross switches 46 are turned on and the other switches are turned off. It should be noted that, as for the switches connected to the intermediate nodes 550_1 and 550_M, the dummy cross switch 47_1 and 47_M are turned on in place of the second cross switches 46_1 and 46_M (or the first cross switches 44_1 and 44_M), which are not actually disposed.

FIGS. 8A to 8F illustrate example switching of the connection state of the first switching circuitry 581, according to one or more embodiments. In the embodiment illustrated, the connection state of the first switch circuitry 581 is periodically switched depending on display lines selected to be driven. For example, the first switch circuitry 581 may be switched among the straight connection state and the cross connection state with a periodicity of time during which six display lines are driven (or with a periodicity of six horizontal sync periods). In vertical sync period #6n−5, the first switch circuitry 581 may be placed in the straight connection state in driving when display lines #1 and #2 are driven; placed in the first cross connection state when display lines #3 and #4 are driven; and placed in the second cross connection state when display lines #5 and #6 are driven. In such embodiments, the output amplifiers 570 that output drive voltages to the respective output terminals 160 are switched by switching the connection state of the first switch circuitry 581, and this achieves spatial averaging of the output offsets of the output amplifiers 570.

The connection state of the second switch circuitry 560 in each output amplifier 570 may be periodically switched depending on display lines selected to be driven. For example, as illustrated in FIGS. 8A to 8F, the second switch circuitry 560 may be switched between the A-type connection state and the B-type connection state with a periodicity of time during which two display lines are driven (or with a periodicity of two horizontal sync periods). The switching of the connection state of the second switch circuitry 560 may achieve spatial averaging of the output offsets of the output amplifiers 570.

The connection states of the first switch circuitry 581 and the second switch circuitry 560 of each output amplifier 570 may be switched with a periodicity determined based on the number of the connection states of the first switch circuitry 581 and the number of the connection states of the second switch circuitry 560. For example, as illustrated in FIGS. 8A to 8F, the connection states of the first switch circuitry 581 and the second switch circuitry 560 may be switched with a periodicity of time during which six display lines are driven.

In one or more embodiments, the second switch circuitry 560 may be switched between the A-type connection state and the B-type connection state depending on display lines selected to be driven, while the first switch circuitry 581 is maintained in the straight connection state, the first cross connection state, or the second cross connection state. In vertical sync period #6n−5, for example, as illustrated in FIG. 8A, the second switch circuitry 560 may be switched from the A-type connection state to the B-type connection state while the first switch circuitry 581 is maintained in the straight connection state in the period during which the display lines #1 and #2 are driven. The second switch circuitry 560 may be switched from the A-type connection state to the B-type connection state while the first switch circuitry 581 is maintained in the first cross connection state in the period during which the display lines #3 and #4 are driven. The second switch circuitry 560 may be switched from the A-type connection state to the B-type connection state while the first switch circuitry 581 is maintained in the second cross connection state in the period during which the display lines #5 and #6 are driven.

The connection state of the first switch circuitry 581 may be periodically switched depending on vertical sync periods. For example, as illustrated in FIGS. 8A to 8F, the connection state of the first switch circuitry 581 used to drive the respective display lines may be switched among the straight connection state, the first cross connection state, and the second cross connection state at a periodicity of six vertical sync periods. The switching of the connection state of the first switch circuitry 581 used to drive the display lines depending on vertical sync periods may achieve time-averaging of the output offsets of the output amplifiers 570.

The connection state of the second switch circuitry 560 of each output amplifier 570 may be periodically switched depending on vertical sync periods. For example, as illustrated in FIGS. 8A to 8F, the connection state of the second switch circuitry 560 used to drive the respective display lines may be switched between the A-type connection state and the B-type connection state at a periodicity of two vertical sync periods. The switching of the connection state of the second switch circuitry 560 used to drive the respective display lines depending on vertical sync period may achieve time-averaging of the output offsets of the output amplifiers 570.

The connection states of the first switch circuitry 581 and the second switch circuitry 560 of each output amplifier 570 used to drive the respective display lines may be switched with a periodicity determined based on the number of the connection states of the first switch circuitry 581 and the number of the connection states of the second switch circuitry 560. For example, as illustrated in FIGS. 8A to 8F, the connection states of the first switch circuitry 581 and the second switch circuitry 560 used to drive the respective display lines may be switched with a periodicity of six vertical sync periods.

FIGS. 9A and 9B illustrate an example operation of the first switch circuitry 581 in other embodiments. In the embodiment illustrated, the connection state of the first switch circuitry 581 used to drive the respective display lines is independent of vertical sync periods. For example, as illustrated in FIGS. 9A and 9B, the connection state of the first switch circuitry 581 used to drive display lines #1 and #2 may be fixed to the straight connection state in vertical sync periods #2n−1 and #2n. Also in such embodiments, the output offsets of the output amplifiers 570 may be time-averaged by switching the connection state of the second switch circuitry 560 depending on vertical sync periods.

The processing system 10 may be configured to switch the connection states of the first switch circuitry 581 and the second switch circuitry 560 depending on display lines selected to be driven and/or vertical sync periods in a different way, not limited to the embodiments illustrated in FIGS. 8A to 8F, 9A and 9B. In various embodiments, the number of display lines selected to be driven and/or the number of vertical sync periods that fall in one cycle of periodicity may be arbitrarily selected.

Figure 10:
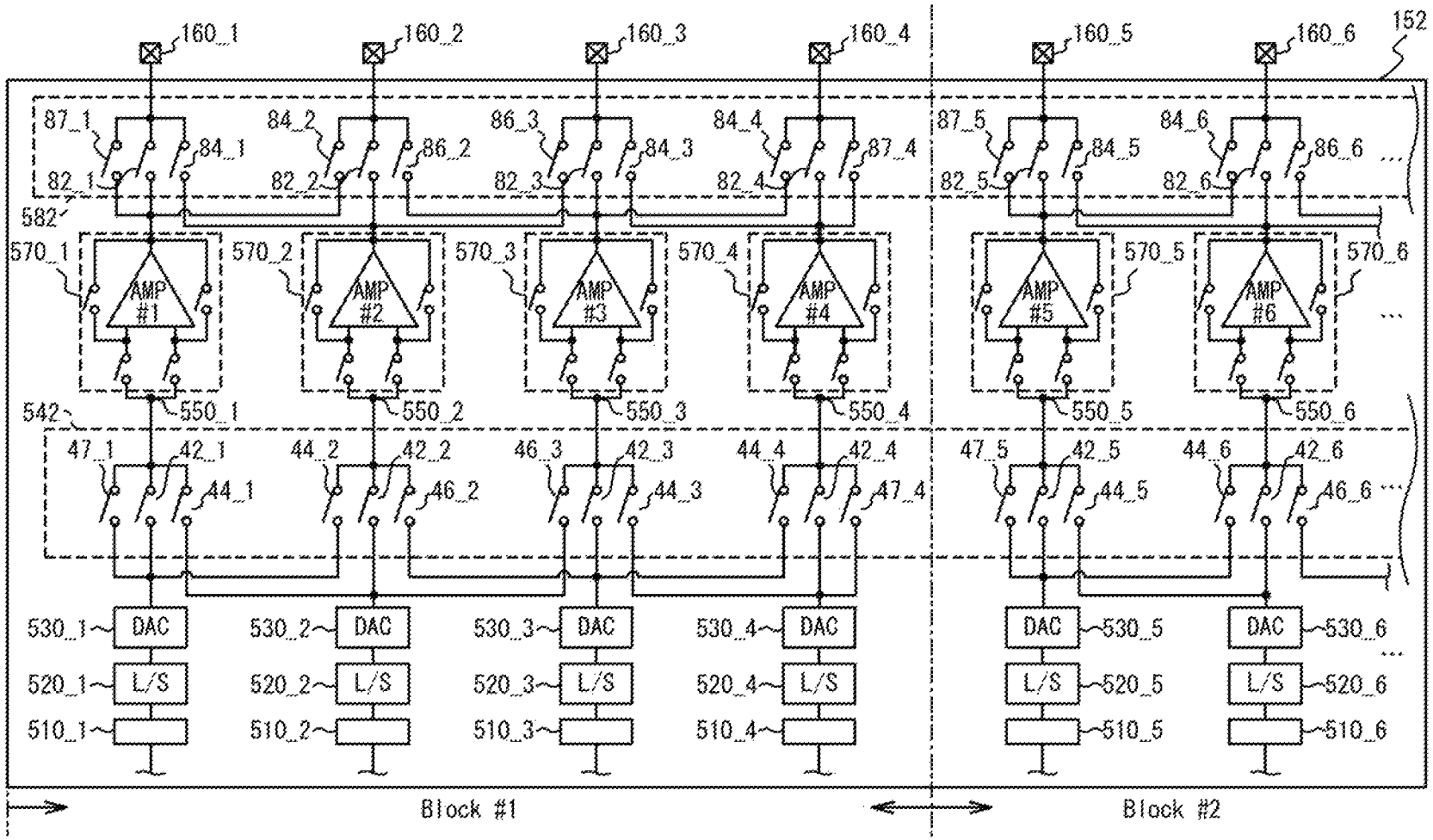
FIG. 10 illustrates an example configuration of data line driver circuitry, according to one or more embodiments.

FIG. 10 illustrates an example configuration of the processing system 10, according to other embodiments. In the embodiment illustrated, the processing system 10 comprises data line driver circuitry 152 in place of the data line driver circuitry 150 described in relation to FIG. 2. The data line driver circuitry 152 may comprise first switch circuitry 582 and third switch circuitry 542. The data line driver circuitry 152 may further comprise a plurality of latch circuits 510, a plurality of level shifters 520, a plurality of DACs 530, and a plurality of output amplifiers 570, similarly to the embodiment illustrated in FIG. 7.

In one or more embodiments, the data line driver circuitry 152 comprise a plurality of blocks each comprising N output terminals 160, for example, four output terminals 160. It should be noted that FIG. 10 only illustrates block #1 and a part of block #2. Each block is configured to allow a selected one of two or three output amplifiers 570 to output a drive voltage to each output terminal 160. Each block may be configured to connect each of the output terminals 160 located at both ends, for example, the output terminals 160_1 and 160_4 to a selected one of two corresponding output amplifiers 570. Each block may be further configured to connect each of other output terminals 160 (e.g., the output terminals 160_2 and 160_3) to a selected one of three corresponding output amplifiers 570.

The first switch circuitry 582 may comprise a plurality of straight switches 82, a plurality of first cross switches 84, a plurality of second cross switches 86, and one or more dummy cross switches 87, similarly to the embodiment described in relation to FIG. 7. The connection states of the first switch circuitry 582 may include the straight connection state, the first cross connection state, and the second cross connection state, similarly to the embodiment described in relation to FIG. 7.

The third switch circuitry 542 may comprise a plurality of straight switches 42, a plurality of first cross switches 44, a plurality of second cross switches 46, and one or more dummy cross switches 47, similarly to the embodiment described in relation to FIG. 7. The connection states of the third switch circuitry 542 may also include the straight connection state, the first cross connection state, and the second cross connection state, similarly to the embodiment described in relation to FIG. 7.

The connection state of the third switch circuitry 542 may be switched in accordance with the connection state of the first switch circuitry 582, similarly to the embodiment described in relation to FIG. 7. For example, the third switch circuitry 542 may be placed in the straight connection state when the first switch circuitry 582 is placed in the straight connection state. The third switch circuitry 542 may be placed in the first cross connection state when the first switch circuitry 582 is placed in the first cross connection state. The third switch circuitry 542 may be placed in the second cross connection state when the first switch circuitry 582 is placed in the second cross connection state.

FIGS. 11A to 11F illustrate example switching of the connection state of the first switching circuitry 582, according to one or more embodiments. In the embodiment illustrated the connection state of the first switch circuitry 582 is periodically switched depending on display lines selected to be driven. For example, the first switch circuitry 582 may be switched among the straight connection state, the first cross connection state, and the second cross connection state with a periodicity of time during which six display lines are driven (or with a periodicity of six horizontal sync periods). In such embodiments, the output amplifiers 570 that output drive voltages to the respective output terminals 160 are switched by switching the connection state of the first switch circuitry 582, and this achieves spatial averaging of the output offsets of the output amplifiers 570.

The connection state of the second switch circuitry 560 in each output amplifier 570 may be periodically switched depending on display lines selected to be driven. For example, the second switch circuitry 560 may be switched between the A-type connection state and the B-type connection state with a periodicity of time during which two display lines are driven (or with a periodicity of two horizontal sync periods). The switching of the connection state of the second switch circuitry 560 may achieve spatial averaging of the output offsets of the output amplifiers 570.

In one or more embodiments, the connection states of the first switch circuitry 582 and the second switch circuitry 560 of each output amplifier 570 may be switched with a periodicity determined based on the number of the connection states of the first switch circuitry 582 and the number of the connection states of the second switch circuitry 560. For example, as illustrated in FIGS. 11A to 11F, the connection states of the first switch circuitry 582 and the second switch circuitry 560 may be switched with a periodicity of time during which six display lines are driven.

The connection state of the first switch circuitry 582 may be periodically switched depending on vertical sync periods. For example, as illustrated in FIGS. 11A to 11F, the connection state of the first switch circuitry 582 used to drive the respective display lines may be switched among the straight connection state, the first cross connection state, and the second cross connection state at a periodicity of six vertical sync periods. The switching of the connection state of the first switch circuitry 582 used to drive the respective display lines depending on vertical sync periods may achieve time-averaging of the output offsets of the output amplifiers 570.

In one or more embodiments, the connection states of the first switch circuitry 582 and the second switch circuitry 560 of each output amplifier 570 used to drive the respective display lines may be switched with a periodicity determined based on the number of the connection states of the first switch circuitry 582 and the number of the connection states of the second switch circuitry 560. For example, as illustrated in FIGS. 11A to 11F, the connection states of the first switch circuitry 582 and the second switch circuitry 560 used to drive the respective display lines may be switched with a periodicity of six vertical sync periods.

FIGS. 12A and 12B illustrate an example operation of the first switch circuitry 582 in other embodiments. In the embodiment illustrated, the connection state of the first switch circuitry 582 used to drive the respective display lines is independent of vertical sync periods. For example, the connection state of the first switch circuitry 582 used to drive display lines #1 and #2 may be fixed to the straight connection state in vertical sync periods #2n−1 and #2n. Also in such embodiments, the output offsets of the output amplifiers 570 may be time-averaged by switching the connection state of the second switch circuitry 560 depending on vertical sync periods.

The processing system 10 may be configured to switch the connection states of the first switch circuitry 582 and the second switch circuitry 560 depending on display lines selected to be driven and/or vertical sync periods in a different way, not limited to the embodiments illustrated in FIGS. 11A to 11F, 12A and 12B. In various embodiments, the number of display lines selected to be driven and/or the number of vertical sync periods that fall in one cycle of periodicity may be arbitrarily selected.

In some embodiments, the third switch circuitry 541 may be removed from the processing system 10. In one or more embodiments, the image processing circuitry 130 may be configured to change the order in which the image data are supplied to the data bus 132 in accordance with the connection state of the first switch circuitry 580, 581, or 582. In the embodiment illustrated in FIG. 2, for example, the image processing circuitry 130 may supply the image data in the order of those associated with the output terminals 160_1, 160_2, 160_3, . . . 160_M when the first switch circuitry 580 is placed in the straight connection state. When the first switch circuitry 580 is placed in the cross connection state, the image processing circuitry 130 may supply the image data in the order of those associated with the output terminals 160_2, 160_1, 160_4, and 160_3, while the latch circuit 510_1, 510_2, 510_3, and 510_4 are connected to the output terminals 160_2, 160_1, 160_4, and 160_3, respectively. In other embodiments, the processing system 10 may be configured to accordingly switch the order of updating the latch circuits 510.

In other embodiments, the number of output amplifiers connectable to one output terminal is not limited to two or three. For example, four or more output amplifiers may be selectively connected to one output terminal. In such embodiments, the first switch circuitry and the third switch circuitry may be configured so that one output terminal and one intermediate node are connectable to three or more cross switches. In various embodiments, the processing system 10 may be configured to place the first switch circuitry and the third switch circuitry in one of a plurality of connection states that include the straight connection state and three or more cross connection states depending on display lines selected to be driven and/or vertical sync periods.

While various embodiments have been specifically described herein, a person skilled in the art would appreciate that the technologies disclosed herein may be implemented with various modifications.

What is claimed is:

1. A processing system, comprising:

a plurality of output terminals configured to be connected to data lines of a display panel;

a plurality of output amplifiers configured to output a plurality of drive voltages having the same polarity; and first switch circuitry configured to connect a first output terminal of the plurality of output terminals to a selected one of the plurality of output amplifiers, wherein the first switch circuitry comprises:

a first connection state in which the first output terminal is connected to a first output amplifier of the plurality of output amplifiers, the first connection state to output a first drive voltage of the first output amplifier at the first output terminal, and a second output terminal of the plurality of output terminals is connected to a second output amplifier of the plurality of output amplifiers; and a second connection state in which the first output terminal is connected to the second output amplifier, the second connection state to output a second drive voltage of the second output amplifier at the first output terminal, and the second output terminal is connected to the first output amplifier, and wherein the first drive voltage and the second drive voltage have a same polarity.

2. The processing system according to claim 1, wherein the first switch circuitry further comprises a third connection state in which the first output terminal is connected to a third output amplifier of the plurality of output amplifiers.

3. The processing system of claim 1, wherein the first switch circuitry further comprises a third connection state in which the first output terminal is connected to a third output amplifier of the plurality of output amplifiers and the second output terminal is connected to a fourth output amplifier of the plurality of output terminals.

4. The processing system of claim 3, wherein the plurality of output terminals comprises a third output terminal connected to a same output amplifier of the plurality of output amplifiers in the first connection state and the third connection state of the first switch circuitry.

5. The processing system of claim 1, wherein the first switch circuitry is further configured to switch connections between the plurality of output terminals and the plurality of output amplifiers in response to selection of display lines of the display panel to be driven.

6. A processing system, comprising:

a plurality of output terminals configured to be connected to data lines of a display panel;

a plurality of output amplifiers configured to output a plurality of drive voltages having the same polarity; and first switch circuitry configured to:

connect a first output terminal of the plurality of output terminals to a selected one of the plurality of output amplifiers;

connect a first output amplifier of the plurality of output amplifiers to the first output terminal during an overlapping period when a first display line of the display panel is driven in a first vertical sync period; and connect a second output amplifier of the plurality of output amplifiers to the first output terminal during an overlapping period when the first display line of the display panel is driven in a second vertical sync period, wherein the first switch circuitry comprises:

a first connection state in which the first output terminal is connected to the first output amplifier, the first connection state to output a first drive voltage of the first output amplifier at the first output terminal; and a second connection state in which the first output terminal is connected to the second output amplifier, the second connection state to output a second drive voltage of the second output amplifier at the first output terminal, and wherein the first drive voltage and the second drive voltage have a same polarity.

7. The processing system of claim 6, wherein the first switch circuitry is further configured to connect a third output amplifier of the plurality of output amplifiers to the first output terminal during an overlapping period when the first display line is driven in a third vertical sync period.

8. A processing system, comprising:

a plurality of output terminals configured to be connected to data lines of a display panel;

a plurality of output amplifiers configured to output a plurality of drive voltages having the same polarity;

first switch circuitry configured to connect a first output terminal of the plurality of output terminals to a selected one of the plurality of output amplifiers; and a plurality of intermediate nodes configured to receive a plurality of grayscale voltages, wherein each of the output amplifiers comprises:

an amplifier circuit comprising two input terminals; and second switch circuitry configured to connect a selected one of the two input terminals to an output of the amplifier circuit and connect the other of the two input terminals to one of the plurality of intermediate nodes, wherein the first switch circuitry comprises:

a first connection state in which the first output terminal is connected to a first output amplifier of the plurality of output amplifiers, the first connection state to output a first drive voltage of the first output amplifier at the first output terminal; and a second connection state in which the first output terminal is connected to a second output amplifier of the plurality of output amplifiers, the second connection state to output a second drive voltage of the second output amplifier at the first output terminal, and wherein the first drive voltage and the second drive voltage have a same polarity.

9. The processing system of claim 8, wherein the second switch circuitry is configured to be switched between a first connection state and a second connection state of the second switch circuitry in response to selection of display lines of the display panel to be driven, wherein, in the first connection state of the second switch circuitry, a first input terminal of the two input terminals is connected to the output of the amplifier circuit and a second input terminal of the two input terminals is connected to the one of the plurality of intermediate nodes, and wherein, in the second connection state of the second switch circuitry, the second input terminal is connected to the output of the amplifier circuit and the first input terminal is connected to the one of the plurality of intermediate nodes.

10. The processing system of claim 9, wherein the first switch circuitry comprises:

a third connection state in which the first output terminal is connected to the first output amplifier;

a fourth connection state in which the first output terminal is connected to the second output amplifier; and a fifth connection state in which the first output terminal is connected to a third output amplifier of the plurality of output amplifiers, and wherein the second switch circuitry is configured to be switched between the first connection state and the second connection state of the second switch circuitry while the first switch circuitry is maintained in one of the third connection state, the fourth connection state, and the fifth connection state.

11. A processing system, comprising:

a plurality of output terminals configured to be connected to data lines of a display panel;

a plurality of output amplifiers configured to output a plurality of drive voltages having the same polarity;

a plurality of digital-analog converters (DACs) configured to generate grayscale voltages to be supplied to the plurality of output amplifiers;

first switch circuitry configured to connect a first output terminal of the plurality of output terminals to a selected one of the plurality of output amplifiers; and second switch circuitry configured to connect the plurality of DACs to the plurality of output amplifiers based on connections between the plurality of output terminals and the plurality of output amplifiers, wherein the first switch circuitry comprises:

a first connection state in which the first output terminal is connected to a first output amplifier of the plurality of output amplifiers, the first connection state to output a first drive voltage of the first output amplifier at the first output terminal; and a second connection state in which the first output terminal is connected to a second output amplifier of the plurality of output amplifiers, the second connection state to output a second drive voltage of the second output amplifier at the first output terminal, and wherein the first drive voltage and the second drive voltage have a same polarity.

12. A display device, comprising:

a display panel comprising a plurality of data lines; and a processing system comprising:

a plurality of output terminals configured to be connected to the plurality of data lines;

a plurality of output amplifiers configured to output a plurality of drive voltages, respectively, the drive voltages having the same polarity; and first switch circuitry configured to connect a first output terminal of the plurality of output terminals to a selected one of the plurality of output amplifiers, wherein the first switch circuitry comprises:

a first connection state in which the first output terminal is connected to a first output amplifier of the plurality of output amplifiers, the first connection state to output a first drive voltage of the first output amplifier at the first output terminal, and a second output terminal of the plurality of output terminals is connected to a second output amplifier of the plurality of output amplifiers; and a second connection state in which the first output terminal is connected to the second output amplifier, the second connection state to output a second drive voltage of the second output amplifier at the first output terminal, and the second output terminal is connected to the first output amplifier, and wherein the first drive voltage and the second drive voltage have a same polarity.

13. A display device, comprising:

a display panel comprising a plurality of data lines; and a processing system comprising:

a plurality of output terminals configured to be connected to the plurality of data lines;

a plurality of output amplifiers configured to output a plurality of drive voltages, respectively, the drive voltages having the same polarity; and first switch circuitry configured to:

connect a first output terminal of the plurality of output terminals to a selected one of the plurality of output amplifiers;

connect a first output amplifier of the plurality of output amplifiers to the first output terminal during an overlapping period when a display line is driven in a first vertical sync period; and connect a second output amplifier of the plurality of output amplifiers to the first output terminal during an overlapping period when the display line is driven in a second vertical sync period, wherein the first switch circuitry comprises:

a first connection state in which the first output terminal is connected to the first output amplifier, the first connection state to output a first drive voltage of the first output amplifier at the first output terminal; and a second connection state in which the first output terminal is connected to the second output amplifier, the second connection state to output a second drive voltage of the second output amplifier at the first output terminal, and wherein the first drive voltage and the second drive voltage have a same polarity.

14. The display device of claim 13, wherein the first switch circuitry is further configured to connect a third output amplifier of the plurality of output amplifiers to the first output terminal during an overlapping period when the display line is driven in a third vertical sync period.

15. A display device, comprising:

a display panel comprising a plurality of data lines; and a processing system comprising:

a plurality of output terminals configured to be connected to the plurality of data lines;

a plurality of output amplifiers configured to output a plurality of drive voltages, respectively, the drive voltages having the same polarity;

first switch circuitry configured to connect a first output terminal of the plurality of output terminals to a selected one of the plurality of output amplifiers; and a plurality of intermediate nodes configured to receive a plurality of grayscale voltages, wherein each of the output amplifiers comprises:

an amplifier circuit comprising two input terminals; and second switch circuitry configured to connect a selected one of the two input terminals to an output of the amplifier circuit and connect the other of the two input terminals to one of the plurality of intermediate nodes, wherein the first switch circuitry comprises:

a first connection state in which the first output terminal is connected to a first output amplifier of the plurality of output amplifiers, the first connection state to output a first drive voltage of the first output amplifier at the first output terminal; and a second connection state in which the first output terminal is connected to a second output amplifier of the plurality of output amplifiers of the plurality of output amplifiers, the second connection state to output a second drive voltage of the second output amplifier at the first output terminal, and wherein the first drive voltage and the second drive voltage have a same polarity.

16. A method, comprising:

outputting, when a switch circuitry is in a first connection state, a first drive voltage from a first output amplifier by the switch circuitry to a first output terminal configured to be connected to a first data line of a display panel;

outputting, when the switch circuitry is in a second connection state, a second drive voltage from a second output amplifier by the switch circuitry to the first output terminal, the second drive voltage having the same polarity as the first drive voltage;

outputting a third drive voltage from the first output amplifier to a second output terminal configured to be connected to a second data line of the display panel; and outputting a fourth drive voltage from the second output amplifier to the second output terminal.

17. The method of claim 16, further comprising:

outputting a fifth drive voltage from a third output amplifier to the first output terminal, the fifth drive voltage having the same polarity as the first drive voltage.

* * * * *